US011590637B2

(12) United States Patent
Kukucka et al.

(10) Patent No.: US 11,590,637 B2
(45) Date of Patent: Feb. 28, 2023

(54) METHODS AND APPARATUSES FOR EXTRACTING AND DISLODGING FASTENERS

(71) Applicant: GRIP HOLDINGS LLC, Brandon, FL (US)

(72) Inventors: Paul Kukucka, Brandon, FL (US); Thomas Stefan Kukucka, Brandon, FL (US)

(73) Assignee: GRIP HOLDINGS LLC, Brandon, FL (US)

( * ) Notice: Subject to any disclaimer, the term of this patent is extended or adjusted under 35 U.S.C. 154(b) by 0 days.

(21) Appl. No.: 17/672,538

(22) Filed: Feb. 15, 2022

(65) Prior Publication Data

US 2022/0168877 A1 Jun. 2, 2022

Related U.S. Application Data

(63) Continuation-in-part of application No. 17/336,236, filed on Jun. 1, 2021, and a continuation-in-part of application No. 16/514,117, filed on Jul. 17, 2019, which is a continuation-in-part of application No. 16/255,341, filed on Jan. 23, 2019, now Pat. No. 11,154,969, which is a continuation-in-part of application No. 16/107,842, filed on Aug. 21, 2018, now Pat. No. 10,780,556, and a continuation-in-part of application No. PCT/IB2017/054379, filed on Jul. 19, 2017, and a continuation-in-part of application No. 15/601,864, filed on May 22, 2017, now (Continued)

(51) Int. Cl.

| | |
|---|---|
| ***B25B 27/18*** | (2006.01) |
| ***B25B 23/10*** | (2006.01) |
| ***B25B 23/00*** | (2006.01) |

(52) U.S. Cl.

CPC ..... *B25B 27/18* (2013.01); *B25B 23/0035* (2013.01); *B25B 23/108* (2013.01)

(58) Field of Classification Search

CPC ..... B25B 27/18; B25B 13/065; B25B 13/50; B25B 23/0035; B25B 23/108

USPC ..... 81/461, 53.2, 186, 124.1, 121.1–125.1

See application file for complete search history.

(56) References Cited

U.S. PATENT DOCUMENTS 848,194 A * 3/1907 McMurtry ..... B25B 23/0057 81/125

1,798,944 A 3/1931 Jackman (Continued)

FOREIGN PATENT DOCUMENTS

| | | |
|---|---|---|
| AU | 201612229 | 4/2016 |
| AU | 201612720 | 6/2016 |

(Continued)

*Primary Examiner* — Orlando E Aviles
*Assistant Examiner* — Marcel T Dion

(57) ABSTRACT

A method of using a fastener torque-tool body, torque arm, and release bolt to engage a stripped threaded fastener in an object. The method comprising the steps of selecting a torque-tool body suitable for the fastener being removed, engaging the torque-tool body with the fastener, engaging the torque arm with the torque-tool body, applying rotational force to the torque arm to rotate the fastener within the object, engaging the release bolt with the torque-tool body, and applying rotational force to the release bolt to dislodge the fastener from the torque-tool body.

23 Claims, 22 Drawing Sheets

Related U.S. Application Data abandoned, said application No. 16/107,842 is a continuation-in-part of application No. PCT/IB2017/052453, filed on Apr. 27, 2014.

(60) Provisional application No. 62/733,507, filed on Sep. 19, 2018.

(56) References Cited

U.S. PATENT DOCUMENTS 2,277,945 A * 3/1942 Ashleman ..... B25B 23/065 81/124.1
2,811,883 A * 11/1957 Cleaves ..... B25B 23/0057 81/177.85
3,104,569 A * 9/1963 Davis ..... B25B 23/103 81/53.2
3,405,377 A 10/1968 Pierce
3,495,485 A 2/1970 Knudsen
3,902,384 A 9/1975 Ehrler
3,908,489 A 9/1975 Yamamoto et al.
3,913,427 A * 10/1975 Brase ..... B25B 27/18 81/53.2
4,074,597 A 2/1978 Jansson
4,507,991 A * 4/1985 Lemke ..... B25B 21/002 81/463
4,536,115 A 8/1985 Helderman
4,598,616 A 7/1986 Colvin
4,607,547 A 8/1986 Martus
4,651,596 A * 3/1987 Rachanski ..... B25B 13/44 81/53.2
4,777,850 A * 10/1988 Polonsky ..... B25B 27/18 81/53.2
4,893,530 A 1/1990 Warheit
4,920,833 A * 5/1990 Rosenthal ..... B25B 27/0014 411/40
4,927,020 A 5/1990 Randy
4,930,378 A 6/1990 Colvin
5,019,080 A 5/1991 Hemer
5,031,487 A * 7/1991 Polonsky ..... B25B 27/18 81/53.2
5,219,392 A 6/1993 Ruzicka et al.
5,228,570 A 7/1993 Robinson
5,251,521 A 10/1993 Burda et al.
5,398,823 A 3/1995 Anders
5,481,948 A 1/1996 Zerkovitz
5,501,342 A 3/1996 Geibel
5,519,929 A 5/1996 Bleckman
5,645,177 A 7/1997 Lin
5,649,791 A * 7/1997 Connolly ..... B25B 27/18 408/241 B
5,669,516 A 9/1997 Horn
5,725,107 A 3/1998 Dembicks
5,737,981 A 4/1998 Hildebrand
5,743,394 A 4/1998 Martin
5,782,148 A 7/1998 Kerkhoven
5,829,327 A 11/1998 Stanton
5,832,792 A 11/1998 Hsieh
5,904,076 A * 5/1999 Siwy ..... B25B 13/065 81/53.2
6,009,778 A 1/2000 Hsieh
6,079,299 A 6/2000 Sundstrom
6,092,279 A 7/2000 Shoup
6,352,011 B1 3/2002 Fruhm
6,431,373 B1 8/2002 Blick
6,575,057 B1 6/2003 Ploeger
6,698,316 B1 3/2004 Wright
6,755,098 B2 6/2004 Huang
6,761,089 B2 7/2004 Bergamo
6,857,340 B2 2/2005 Wagner
6,951,156 B2 10/2005 Garg
7,000,501 B1 2/2006 Chen
D524,615 S 7/2006 Albertson
7,225,710 B2 6/2007 Pacheco, Jr.
7,331,260 B2 2/2008 Cheng
7,434,494 B1 10/2008 Snider
7,717,278 B2 1/2010 Kao
D614,931 S 5/2010 Su
7,788,994 B2 9/2010 Wright et al.
7,814,814 B2 * 10/2010 Whitehead ..... B25B 27/18 81/53.2
7,841,480 B2 11/2010 Hsieh
7,913,593 B2 3/2011 Dahar et al.
8,166,851 B2 5/2012 Pchola
8,302,255 B2 11/2012 Lin
8,336,709 B1 12/2012 Geibel
D745,814 S 12/2015 Hsieh
D776,505 S 1/2017 Doroslovac
D784,106 S 4/2017 Doroslovac
9,687,968 B2 6/2017 Doroslovac et al.
D794,405 S 8/2017 Doroslovac et al.
9,718,170 B2 8/2017 Eggert et al.
D798,682 S 10/2017 Doroslovac et al.
9,873,195 B1 1/2018 Buxton
9,878,441 B1 1/2018 Kao
D829,069 S 9/2018 Doroslovac et al.
10,081,094 B2 9/2018 Doroslovac et al.
10,328,554 B2 6/2019 Todd
D859,944 S 9/2019 Kukucka et al.
D859,945 S 9/2019 Kukucka et al.
D859,946 S 9/2019 Kukucka et al.
D859,947 S 9/2019 Kukucka et al.
D867,841 S 11/2019 Kukucka et al.
D868,553 S 12/2019 Kukucka et al.
D879,577 S 3/2020 Kukucka et al.
D880,968 S 4/2020 Kukucka et al.
D880,977 S 4/2020 Kukucka et al.
D885,149 S 5/2020 Kukucka et al.
D887,233 S 6/2020 Kukucka et al.
D887,711 S 6/2020 Kukucka et al.
D889,224 S 7/2020 Kukucka et al.
D889,257 S 7/2020 Kukucka et al.
D892,578 S 8/2020 Kukucka et al.
10,780,556 B2 9/2020 Kukucka et al.
10,786,890 B2 9/2020 Kukucka et al.
D899,091 S 10/2020 Carboy
10,828,766 B2 11/2020 Kukucka et al.
D904,152 S 12/2020 Kukucka et al.
D906,781 S 1/2021 Kukucka et al.
10,882,162 B2 1/2021 Kukucka et al.
D909,842 S 2/2021 Kukucka et al.
D910,490 S 2/2021 Lim et al.
10,919,133 B2 2/2021 Kukucka et al.
10,967,488 B2 4/2021 Kukucka et al.
2003/0209111 A1 11/2003 Huang
2004/0256263 A1 12/2004 Shih
2005/0098459 A1 5/2005 Gorman
2005/0103664 A1 5/2005 Shih
2005/0183548 A1 * 8/2005 Horobec ..... B25B 13/065 81/53.2
2005/0257357 A1 11/2005 Huang
2005/0274233 A1 12/2005 Lin
2006/0130618 A1 6/2006 Hsieh
2006/0156869 A1 7/2006 Hsieh
2006/0266168 A1 11/2006 Pacheco, Jr.
2007/0261519 A1 11/2007 Cheng
2008/0235930 A1 * 10/2008 English ..... B25B 27/062 29/256
2009/0007732 A1 1/2009 Hsieh
2009/0120885 A1 5/2009 Kao
2009/0220321 A1 9/2009 Sakamura
2011/0056339 A1 3/2011 Su
2011/0303052 A1 12/2011 Chen
2012/0060656 A1 * 3/2012 Chang ..... B25B 23/0035 81/439
2012/0132039 A1 5/2012 Su
2013/0047798 A1 2/2013 Huang
2014/0260832 A1 9/2014 Chen
2014/0311302 A1 10/2014 Taguchi et al.
2014/0331826 A1 11/2014 Campbell
2014/0360321 A1 12/2014 Steinweg et al.
2015/0135910 A1 5/2015 Eggert et al.
2015/0266169 A1 9/2015 Campbell, II
2015/0314429 A1 11/2015 Doroslovac

(56) References Cited

U.S. PATENT DOCUMENTS

| | | | |
|---|---|---|---|
| 2015/0321332 | A1 | 11/2015 | Lee |
| 2016/0067853 | A1 | 3/2016 | Neto |
| 2016/0136792 | A1 | 5/2016 | Harp |
| 2016/0223005 | A1 | 8/2016 | Rathmann |
| 2016/0271764 | A1 | 9/2016 | Huang |
| 2016/0339564 | A1 | 11/2016 | Chen |
| 2017/0028538 | A1 | 2/2017 | Lourenco et al. |
| 2017/0246733 | A1 | 8/2017 | Shehab |
| 2017/0252905 | A1 | 9/2017 | Doroslovac |
| 2017/0282337 | A1 | 10/2017 | Johnson et al. |
| 2017/0312839 | A1 | 11/2017 | Asanuma |
| 2017/0312897 | A1 | 11/2017 | Doroslovac et al. |
| 2018/0003241 | A1 | 1/2018 | Goss |
| 2018/0141192 | A1 | 5/2018 | Chang |
| 2018/0354022 | A1 | 12/2018 | Ross et al. |
| 2018/0354102 | A1 | 12/2018 | Kukucka et al. |
| 2019/0001469 | A1 | 1/2019 | Cho et al. |
| 2019/0015961 | A1 | 1/2019 | Kukucka et al. |
| 2019/0152033 | A1 | 5/2019 | Kukucka et al. |
| 2019/0283233 | A1 | 9/2019 | Kukucka et al. |
| 2019/0337131 | A1 | 11/2019 | Kukucka et al. |
| 2019/0375077 | A1 | 12/2019 | Kukucka et al. |
| 2020/0078908 | A1 | 3/2020 | Wu et al. |
| 2020/0298380 | A1 | 9/2020 | Eggert et al. |
| 2020/0376648 | A1 | 12/2020 | Kukucka et al. |
| 2020/0391360 | A1 | 12/2020 | Kukucka et al. |
| 2021/0039245 | A1 | 2/2021 | Kukucka et al. |

FOREIGN PATENT DOCUMENTS

| | | | |
|---|---|---|---|
| AU | 201612721 | | 6/2016 |
| CA | 2564093 | A1 | 4/2007 |
| CA | 168071 | | 12/2016 |
| CA | 2898480 | A1 | 7/2017 |
| CN | 2767068 | Y | 3/2006 |
| CN | 3630254 | | 6/2006 |
| CN | 201046555 | Y | 4/2008 |
| CN | 102395447 | | 3/2012 |
| CN | 102554833 | A | 7/2012 |
| CN | 103639950 | A | 3/2014 |
| CN | 303924849 | | 11/2016 |
| CN | 303956827 | | 12/2016 |
| CN | 303984883 | | 12/2016 |
| DE | 3911409 | A1 | 10/1990 |
| DE | 9403220 | U1 | 4/1994 |
| DE | 4321325 | A1 | 1/1995 |
| DE | 29613327 | U1 | 9/1996 |
| DE | 10321284 | A1 | 12/2004 |
| DE | 202010006146 | U1 | 7/2010 |
| DE | 102013021238 | A1 | 6/2015 |
| EP | 0930132 | A2 | 7/1999 |
| EP | 0930132 | A3 | 11/2000 |
| EP | 1371453 | A2 | 12/2003 |
| EP | 1731774 | A1 | 12/2006 |
| EP | 0930132 | B1 | 4/2007 |
| GB | 906839 | A | 9/1962 |
| GB | 1294764 | A | 11/1972 |
| GB | 2366532 | A | 3/2002 |
| JP | 2011143522 | | 7/2011 |
| JP | 2012157913 | | 10/2011 |
| JP | 2015180835 | A | 7/2017 |
| KR | 200149097 | Y1 | 7/1999 |
| RU | 2152870 | C1 | 7/2000 |
| RU | 2225786 | C2 | 1/2001 |
| RU | 45671 | U1 | 5/2005 |
| RU | 58510 | U1 | 11/2006 |
| RU | 2387533 | C1 | 4/2010 |
| RU | 116398 | | 5/2012 |
| RU | 180548 | U1 | 6/2018 |
| SU | 16616 | A1 | 8/1930 |
| TW | 201341127 | A | 10/2013 |
| WO | 1994016862 | A1 | 8/1994 |
| WO | 1996010932 | A1 | 4/1996 |
| WO | 1996026870 | A1 | 9/1996 |
| WO | 1996027745 | A1 | 9/1996 |
| WO | 1997010926 | A1 | 3/1997 |
| WO | 1998012982 | A1 | 4/1998 |
| WO | WO9812982 | A1 | 4/1998 |
| WO | 999032264 | | 7/1999 |
| WO | 1999032264 | A1 | 7/1999 |
| WO | 2001066312 | A1 | 9/2001 |
| WO | 2004002687 | A1 | 1/2004 |
| WO | 2005070621 | | 8/2005 |
| WO | 2006023374 | | 3/2006 |
| WO | 2006130490 | A1 | 12/2006 |
| WO | 2010007402 | A1 | 1/2010 |
| WO | 2011109040 | A1 | 9/2011 |
| WO | 2013028875 | A1 | 2/2013 |
| WO | WO2015050942 | A1 | 4/2015 |
| WO | 2015082283 | A1 | 6/2015 |
| WO | 2015050942 | A1 | 9/2015 |
| WO | 2016051080 | A1 | 4/2016 |
| WO | DM/090809 | | 4/2016 |
| WO | DM/091188 | | 5/2016 |
| WO | DM/091189 | | 5/2016 |
| WO | 2016174615 | A1 | 11/2016 |
| WO | WO2017069953 | A1 | 4/2017 |
| WO | 2017178997 | | 10/2017 |
| WO | 2017187388 | A1 | 11/2017 |
| WO | 2018172831 | | 9/2018 |
| WO | 2019012486 | | 1/2019 |
| WO | 2019167032 | | 9/2019 |
| WO | 2019175652 | | 9/2019 |
| WO | 2020039281 | | 2/2020 |
| WO | 2020039285 | | 2/2020 |
| WO | 2020058777 | | 3/2020 |
| WO | 2020152516 | | 7/2020 |
| WO | 2020208608 | | 10/2020 |
| WO | 2020225800 | | 11/2020 |
| WO | 2021001696 | | 1/2021 |
| WO | 2021019500 | | 2/2021 |
| WO | 2021033152 | | 2/2021 |

* cited by examiner

METHODS AND APPARATUSES FOR EXTRACTING AND DISLODGING FASTENERS

FIELD OF THE INVENTION

The present invention relates generally to tools and methods for extracting and removing fasteners, particularly bolts and nuts. More specifically, the present invention discloses methods for using extractors and dislodging tools to remove damaged fasteners.

BACKGROUND OF THE INVENTION

Hex bolts, nuts, screws, and other similar threaded devices are used to secure and hold multiple components together by being engaged to a complimentary thread, known as a female thread. The general structure of these types of fasteners is a cylindrical shaft with an external thread and a head at one end of the shaft. The external thread engages a complimentary female thread tapped into a hole or a nut and secures the fastener in place, fastening the associated components together. The head receives an external torque force and is the means by which the fastener is turned, or driven, into the female threading. The head is shaped specifically to allow an external tool like a wrench to apply a torque to the fastener in order to rotate the fastener and engage the complimentary female threading to a certain degree. This type of fastener is simple, extremely effective, cheap, and highly popular in modern construction. One of the most common problems in using these types of fasteners, whether male or female, is the tool slipping in the head portion, or slipping on the head portion. This is generally caused by either a worn fastener or tool, corrosion, overtightening, or damage to the head portion of the fastener. Various methods may be used to remove a fastener, some more aggressive than others. Once a fastener head is damaged, a more aggressive method must be implemented to remove a seized fastener. Drilling out the fastener is a common method used by some users to dislodge the fastener. While this method can prove to be effective in some scenarios there is a high risk of damaging the internal threads of the hole.

The present invention is a method of using a fastener extractor and dislodging tool to eliminate the chance of slippage. The present invention uses a fastener extractor with gripping edges to bite into the head of the fastener and allow for efficient torque transfer between the extractor bit and the head portion of the fastener. The present invention also overcomes another common issue of the traditional bolt extraction, which is material from the fastener heat or the actual fastener being attached or stuck to the extractor tool. More specifically, the present invention allows users to easily dislodge any remaining material and/or the removed fastener from the extracting tool through a dislodging tool.

DETAIL DESCRIPTIONS OF THE INVENTION

All illustrations of the drawings are for the purpose of describing selected versions of the present invention and are not intended to limit the scope of the present invention.

The present invention generally relates to methods for using extracting tools and extracting tool accessories. More specifically the present invention discloses a method of using a fastener extractor and dislodging tool apparatus to remove a damage/stripped fastener. Once the damage/stripped fastener is removed through the extracting tool, dislodging of the damaged/stripped fastener from the extractor tool can prove to be a difficult task. The present invention aims to solve this issue by disclosing a release tool that is selectively engaged into the extractor tool. The release tool is used to assist users with removing any pieces of damaged/stripped fasteners which may have been wedged onto the extractor tool during removal. Furthermore, the present invention is compatible with male-member based head designs of fasteners. Fasteners which utilize a male-member head design, also known as male fasteners, use the external lateral surface of the fastener head to engage a tool for tightening or loosening, such fasteners include hex bolts and nuts. The present invention is further useful for internal driven fasteners also known as socket cap screws that utilize an external socket head design. An example of a male fastener is a bolt with a hex shaped head. In addition, the present invention may be used with male fasteners of a right-hand thread and male fasteners of a left-hand thread. In addition, the present invention is compatible with any types of male threaded shafts. Though the extractor tool used in the present invention is described as a female embodiment, the present invention may utilize a male embodiment using the same elements or components and incorporating the same functions described herein in a opposite or reversed male embodiment.

Figure 1:
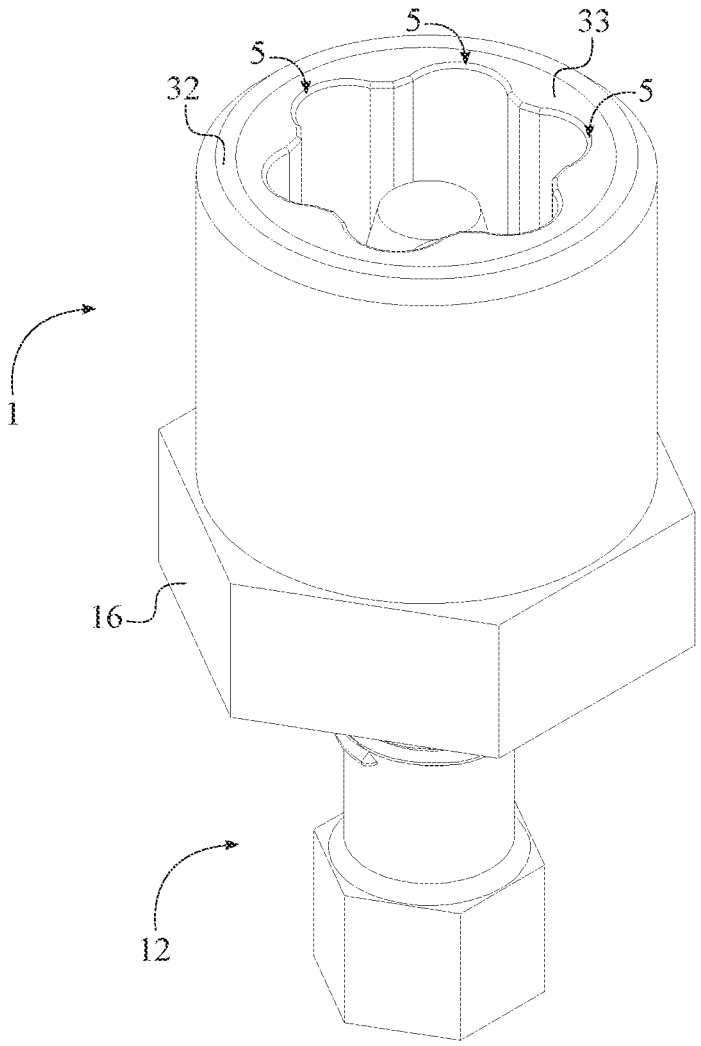
FIG. 1 is a perspective view of the torque-tool body, the plurality of engagement features, and the release bolt.
Figure 3:
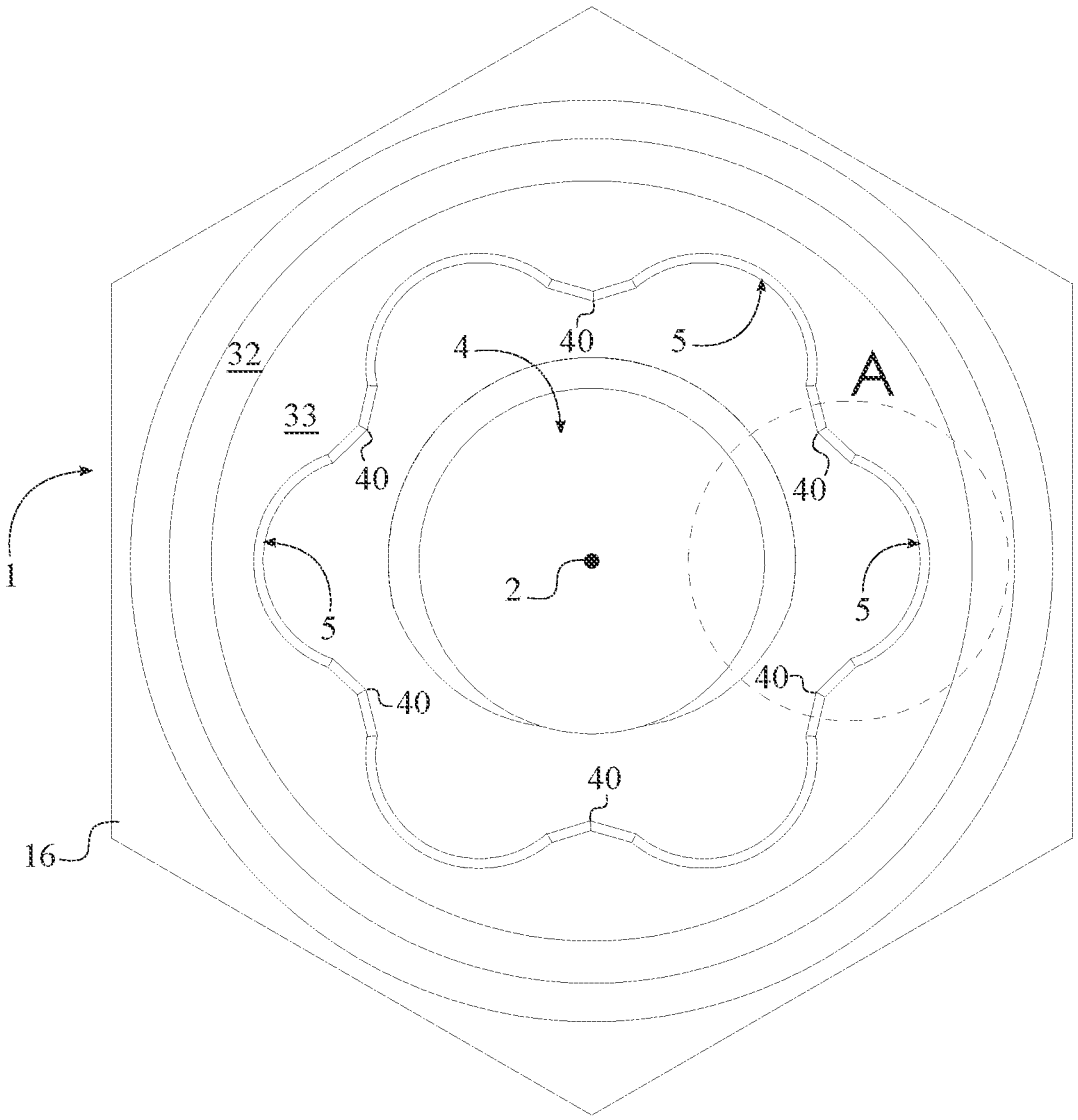
FIG. 3 is a top view of the torque-tool body and the plurality of engagement features of the present invention, showing the section that a detailed view is taken shown in FIG. 4.
Figure 4:
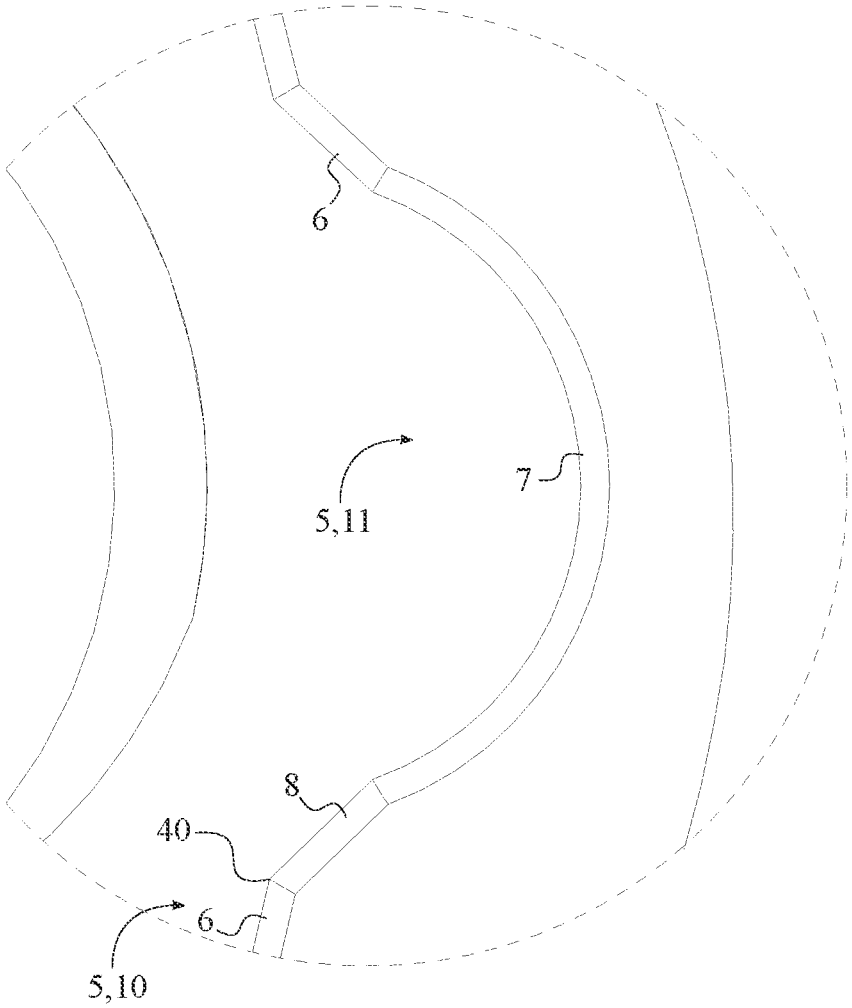
FIG. 4 is a detailed view for the plurality of engagement features taken within section line A.
Figure 8:
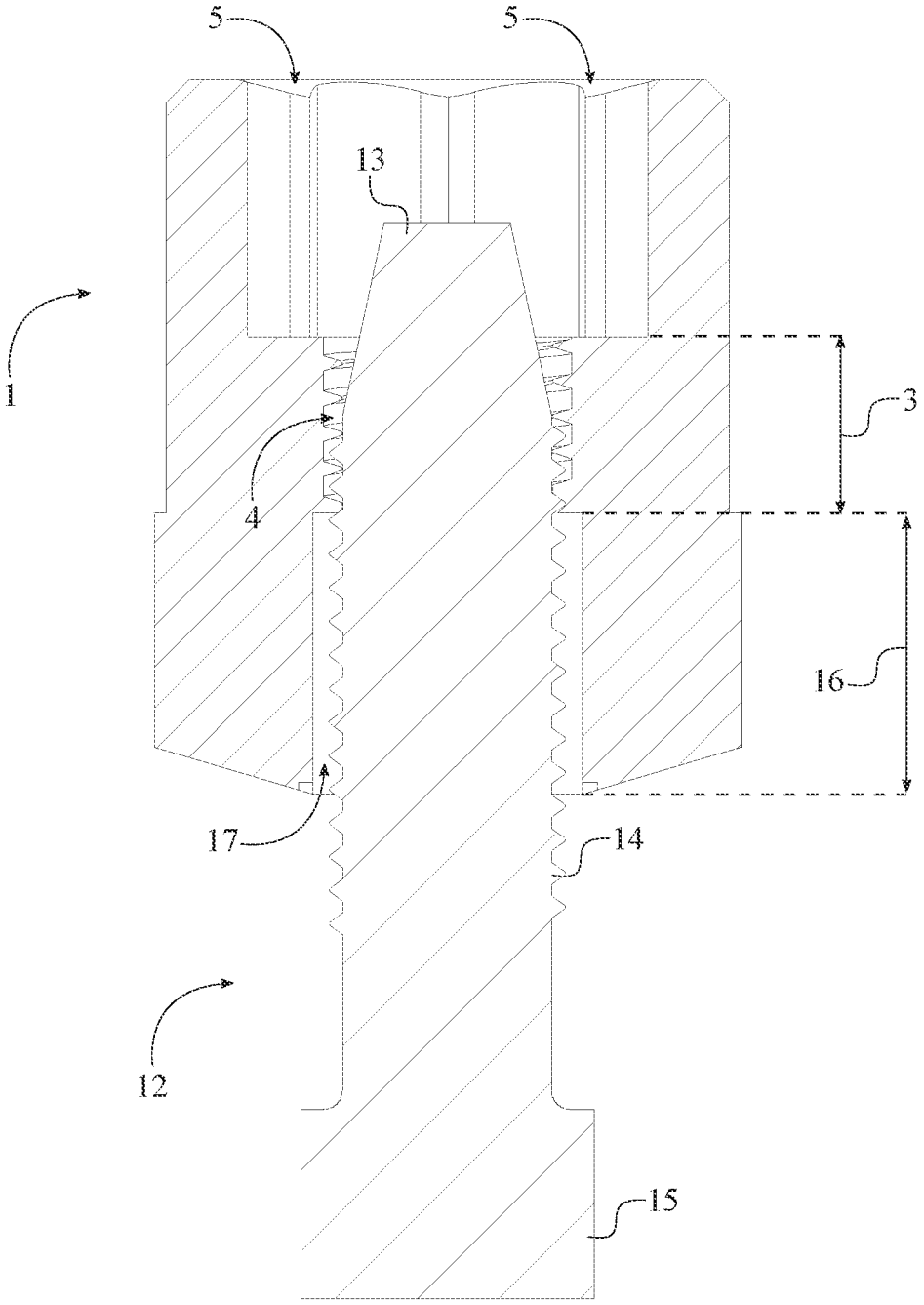
FIG. 8 is a cross sectional view of the torque-tool body, the plurality of engagement features, and the release bolt.

Referring to FIG. 1 and FIG. 8, the fastener extractor used in the present invention comprises a torque-tool body 1 with a threaded opening 4 and a plurality of engagement features 5. The fastener extractor used in the present invention further comprises a release bolt 12. The torque-tool body 1 is used as the physical structure to apply the corresponding force by the plurality of engagement features 5 on the fastener head 61 or the threaded shaft 62. For a male fastener, the torque-tool body 1 is a tubular extrusion sized to fit over the fastener head 61 or the threaded shaft 62 in an interlocking manner, similar to a wrench socket. The length, width, and diameter of the torque-tool body 1 may vary to fit different sized the fastener head 61 or the threaded shaft 62. The plurality of engagement features 5 prevents slippage during fastener extraction and is radially positioned around a rotational axis 2 of the torque-tool body 1 as seen in FIG. 3. More specifically, the plurality of engagement features 5 is perimetrically connected around a base 3 of the torque-tool body 1 to grip the fastener head 61 or the threaded shaft 62. As a result, the plurality of engagement features 5 facilitates the transfer of torque to the fastener head 61 or the threaded shaft 62 by preventing slippage from the torque-tool body 1. Furthermore, the plurality of engagement features 5 is equally spaced about the torque-tool body 1 to create an enclosed profile as seen in FIG. 3-4. The threaded opening 4 concentrically traverses through the base 3 and functions as an attachment feature for the release bolt 12. More specifically, the release bolt 12 is threadedly engaged with the threaded opening 4 and positioned opposite of the plurality of engagement features 5. As a result, when a damaged/stripped fastener 60 is jammed within the plurality of engagement features 5 after removal steps, the release bolt 12 is used to push out or dislodge the damaged/stripped fastener 60 from the plurality of engagement features 5. In an alternative embodiment the threaded opening 4 may be a separate embodiment and detached from the torque tool body 1.

Figure 2:
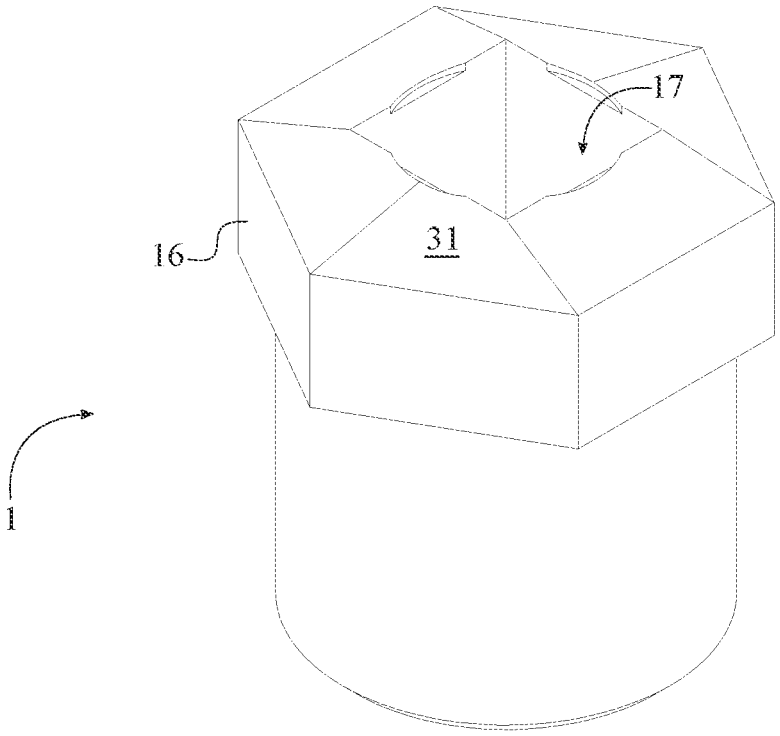
FIG. 2 is a perspective view of the torque-tool body and the bottom surface of the attachment body of the present invention.

In reference to FIG. 1-3, the torque-tool body 1 may be outwardly extended from a cross section of the plurality of engagement features 5. This yields a socket-like structure with the plurality of engagement features 5 being distributed about the rotational axis 2 on the internal surface of the torque-tool body 1, similar to a wrench socket. Additionally, a wrench handle can be externally and laterally connected to the torque-tool body 1 thus yielding a wrench handle attachment. With respect to both the wrench socket and the wrench handle attachment, each of the plurality of engagement features 5 is extended along a specific length of the torque-tool body 1 thus delineating an empty space within the torque-tool body 1. The aforementioned empty space functions as a receptive cavity for the fastener head 61 or the threaded shaft 62 so that the plurality of engagement features 5 can grip the fastener head 61 or the threaded shaft 62.

A traditional socket wrench transfers the majority of the torque to the male fastener 60 through the lateral corners (intersection point of two lateral walls) of the fastener head 61. Over time, the degradation of the lateral corners reduces the efficiency of transferring torque from the socket wrench to the fastener head 61 thus causing slippage. The present invention overcomes this problem by using a fastener extractor that transfers the torque transfer point to the lateral walls 63 of the fastener head 61. This is accomplished through the use of the plurality of engagement features 5. Each of the plurality of engagement features 5 is positioned to engage or "bite" the lateral walls 63 of the fastener head 61 instead of the lateral corner. This ensures an adequate amount of torque is transferred to the fastener head 61 to initiate rotation and, resultantly, extraction of the damaged/stripped fastener 60. When the present invention utilizes the fastener extracor to remove the threaded shaft 62, the plurality of engagement features 5 is positioned to engage or "bite" the radial surface 64 to initiate rotation and, resultantly, extraction of the damaged/stripped fastener 60. This virtually eliminates tool slippage off fasteners, one of the improvements and benefits of the present invention over compared to traditional extracting methods, improving the life expectancy of both the tools and fasteners. This feature is both a cost saving, time saving as well as a safety benefit.

In reference to FIG. 3-4 that illustrates a preferred embodiment of the fastener extractor and dislodging tool of the present invention, a cross section for each of the plurality of engagement features 5 comprises a first slanted section 6, a hollow section 7, and a second slanted section 8. More specifically, the first slanted section 6 is terminally connected to the hollow section 7. The second slanted section 8 is terminally connected to the hollow section 7, wherein the first slanted section 6 and the second slanted section 8 are oppositely positioned of each other about the hollow section 7. The length of the first slanted section 6, the hollow section 7, and the second slanted section 8 may change. Similarly, corresponding angles between the first slanted section 6, the hollow section 7, the second slanted section 8 may vary to create a sharper tooth-like shape. The first slanted section 6 and the second slanted section 8 are preferably a planar surface but may incorporate a variety of shapes including concave surfaces, plurality of angled surfaces, straight surfaces, convex surfaces, or combination aforesaid surfaces.

In reference to the preferred embodiment of the torque-tool body 1, a gripping edge 40 is delineated in between a pair of engagement features 5 so that the gripping edge 40 is able to cut "bite" into the fastener head 61 or the threaded shaft 62 during the removal of the damaged/stripped fastener 60. More specifically, the plurality of engagement features 5 comprises an arbitrary engagement feature 10 and an adjacent engagement feature 11 as shown in FIG. 3-4. The arbitrary engagement feature 10 is any feature within the plurality of engagement features 5 in such a way that the adjacent engagement feature 11 is the feature directly next to the arbitrary engagement feature 10. Furthermore, the first slanted section 6 of the arbitrary engagement feature 10 is connected to the second slanted section 8 of the adjacent engagement feature 11 at the gripping edge 40. In order to delineate the enclosed profile of the plurality of engagement features 5 about the gripping edge 40, the first slanted section 6 of the arbitrary engagement feature 10 is connected to the second slanted section 8 of the adjacent engagement feature 11 at an obtuse angle.

Furthermore, when the present invention engages the torque-tool body 1 with the fastener head 61 or the threaded shaft 62, only the gripping edge 40, the first slanted sections 6, and the second slanted section 8 are in contact with the fastener surface. The hollow section 7 does not engage with the fastener surface thus delineating an empty or hollow space. In other words, the hollow section 7 is delineated into the empty space as the empty space is configured to be positioned offset from the fastener 60. Further, the shape of the empty space is preferably a curved or radius shape, but the shape of the empty space may be any shape or shapes as preferred by the user.

Figure 6:
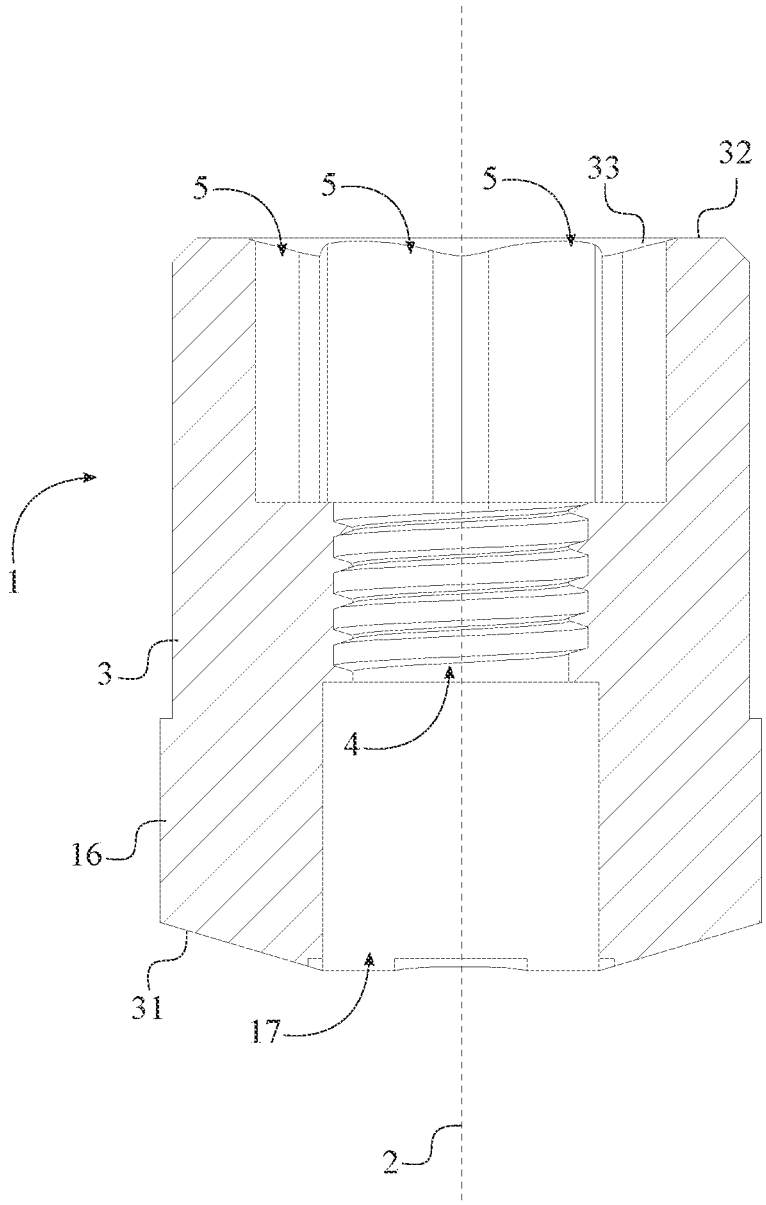
FIG. 6 is a cross section view of the torque-tool body taken along line A-A of FIG. 5, showing the terminally connected attachment body and the engagement bore.

In reference to FIG. 3 and FIG. 6, the present invention further comprises a top flat surface 32 and a top chamfered surface 33. The top flat surface 32 of the torque-tool body 1 is positioned adjacent to an outer surface of the plurality of engagement features 5. Furthermore, a transition edge between the top flat surface 32 and the outer surface of the plurality of engagement features 5 is preferably either a chamfered edge or a curved edge but may be a square edge if preferred. The top flat surface 32 and the top chamfered surface 33 are radially delineated by the plurality of engagement features 5, wherein the top flat surface 32 is perimetrically connected around the top chamfered surface 33. Furthermore, the top flat surface 32 is positioned parallel to a top surface 35 of the base 3. The top chamfered surface 33 is angularly positioned to the top flat surface 32 as the top chamfered surface 33 is oriented towards the top surface 35 of the base 3.

As mentioned above, the torque-tool body 1 may be designed to fit a variety of fastener head designs. This is achieved by varying the number of the plurality of engagement features 5 to compliment different types of fastener head designs. The number of the plurality of engagement features 5 generally corresponds to the number of lateral walls 63 of the fastener head 61. For example, a pentagon shaped fastener head has five lateral walls. In order to remove the male fastener with the pentagon shaped head, a user has to utilize an embodiment of the present invention wherein number of the plurality of engagement features 5 is five engagement features. Preferably, the number of the plurality of engagement features 5 in contact with the fastener head can be eighteen, twelve, six, or four. Although the methods of the present invention are most commonly applied to fasteners having a fastener head 61 with a plurality of lateral walls 63, the methods of the present invention may also be applied to threaded fasteners having a rounded head, such as a wood screw, machine screw, or set screw. Additionally, the methods may be applied to fastener heads radial or angular in shape which have a diameter greater than, equal to, or less than a diameter of the fastener's threaded shaft 62 portion.

Figure 9:
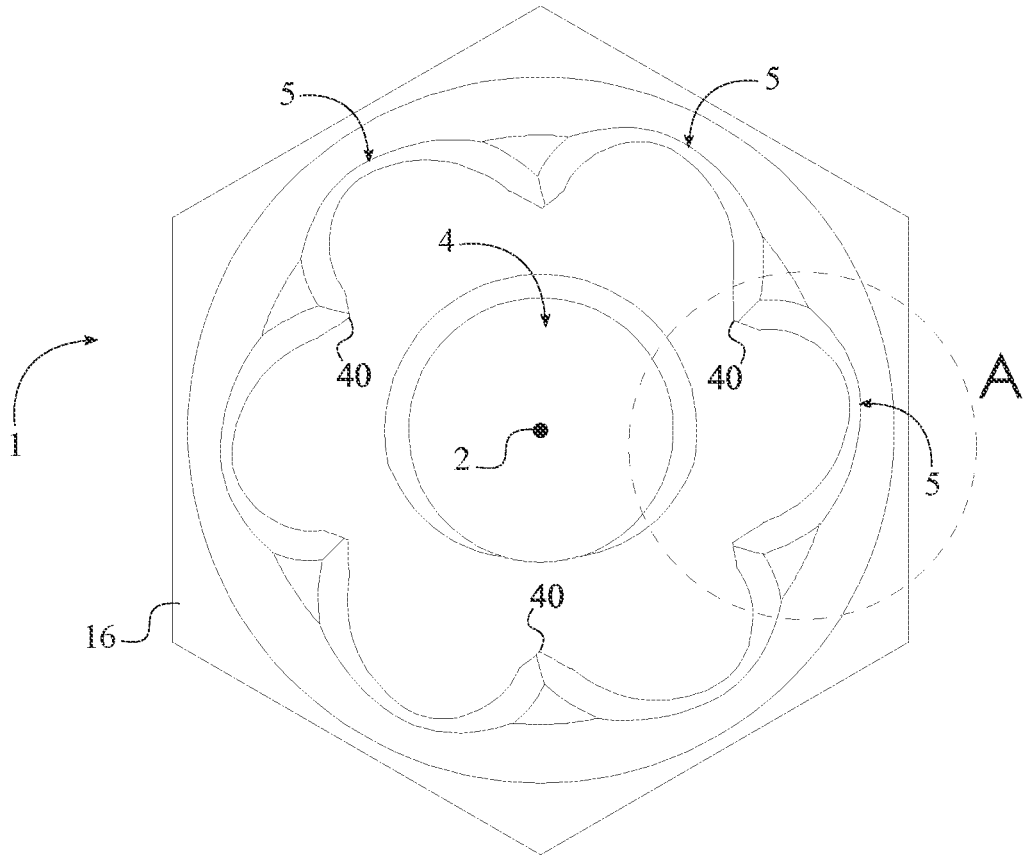
FIG. 9 is a top view of an alternative embodiment of the torque-tool body and the plurality of engagement features of, showing the section that a detailed view is taken shown in FIG. 10.
Figure 10:
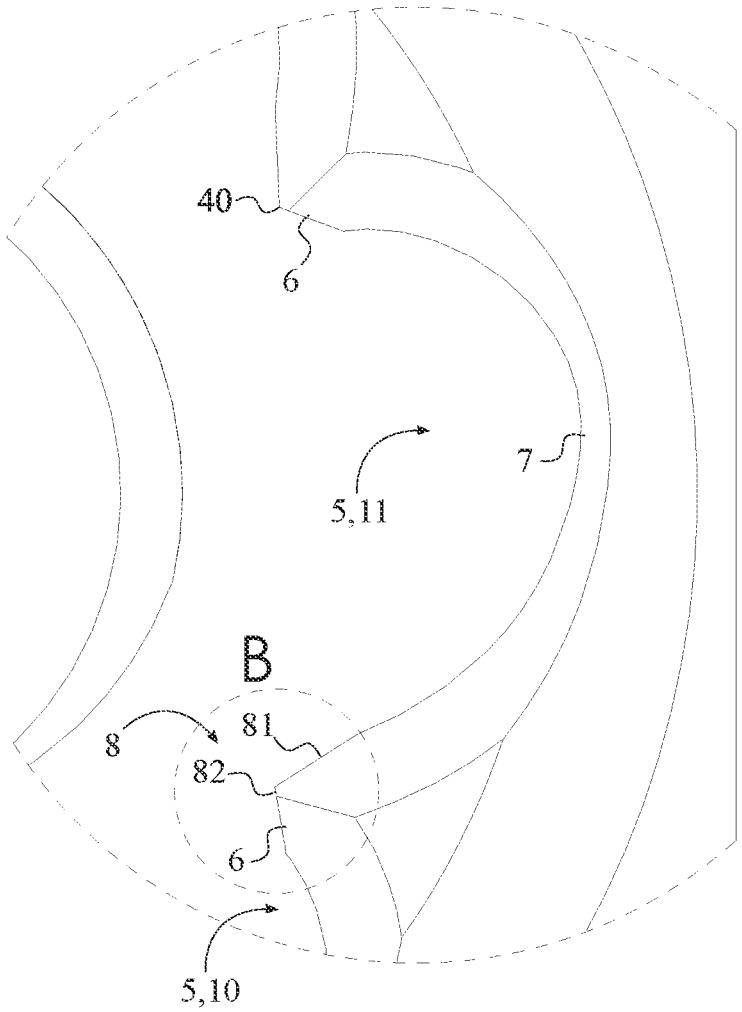
FIG. 10 is a detailed view of the plurality of engagement features of an alternative embodiment the torque-tool body taken within section line A and showing the section that a detailed view is taken shown in FIG. 11.
Figure 11:
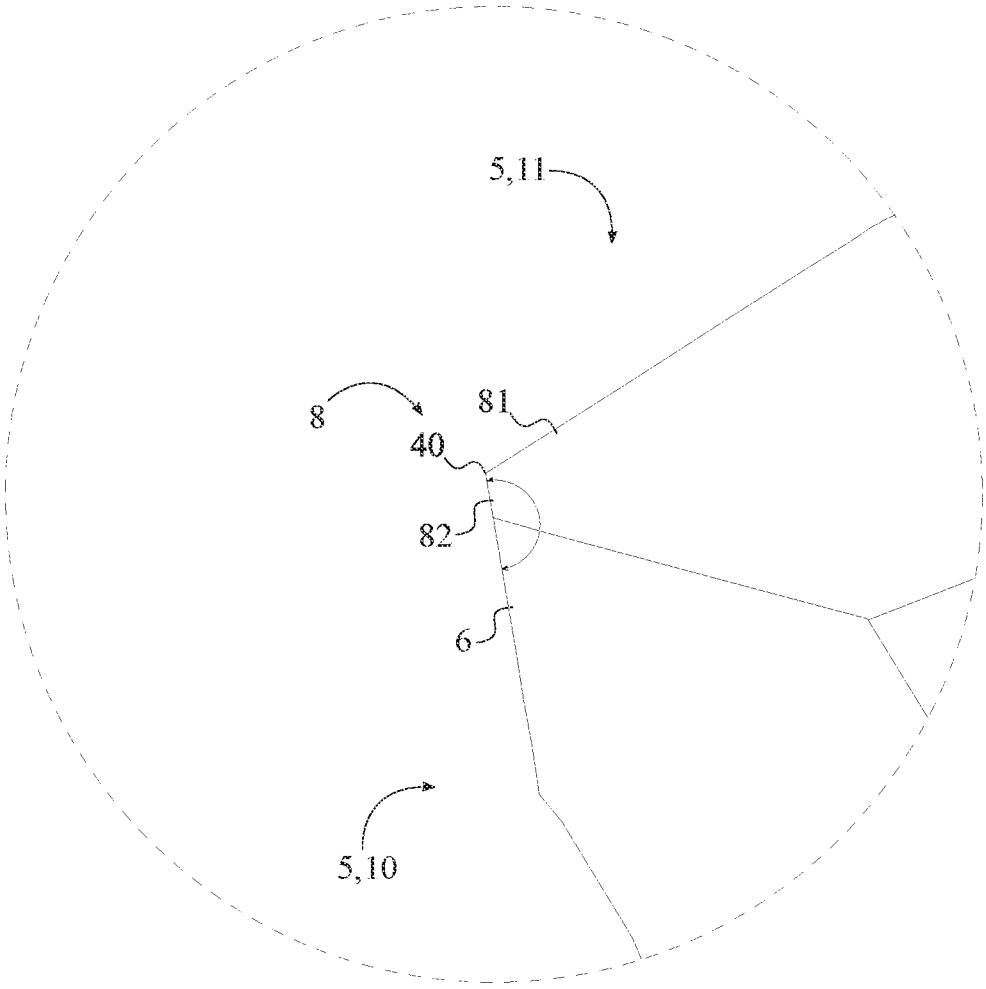
FIG. 11 is a detailed view for the plurality of engagement features of an alternative embodiment the torque-tool body taken within section line B.

In reference to FIG. 9-11 that illustrates a first alternative embodiment of the torque-tool head 1, a cross section for each of the plurality of engagement features 5 comprises the first slanted section 6, the hollow section 7, and the second slanted section 8. The second slanted section 8 further comprises a proximal section 81 and a distal section 82. More specifically, the first slanted section 6 is terminally connected to the hollow section 7. The proximal section 81 of the second slanted section 8 is terminally connected to the hollow section 7, wherein the first slanted section 6 and the proximal section 81 of the second slanted section 8 are oppositely positioned of each other about the hollow section 7. The distal section 82 of the second slanted section 8 is terminally connected to the proximal section 81 of the second slanted section 8 and positioned opposite of the hollow section 7. The length of the first slanted section 6, the hollow section 7, and the second slanted section 8 may change. Similarly, corresponding angles between the first slanted section 6, the hollow section 7, and the second slanted section 8 may vary to create a sharper tooth-like shape.

In reference to the first alternative embodiment of the torque-tool body 1, the gripping edge 40 is delineated in between the proximal section 81 of second slanted section 8 and the distal section 82 of the second slanted section 8 so that the gripping edge 40 is able to cut into the fastener head 61 or the threaded shaft 62 during the removal of the damaged/stripped fastener 60. More specifically, the plurality of engagement features 5 comprises the arbitrary engagement feature 10 and the adjacent engagement feature 11. The arbitrary engagement feature 10 is any feature within the plurality of engagement features 5 in such a way that the adjacent engagement feature 11 is the feature directly next to the arbitrary engagement feature 10. In reference to FIG. 10-11, the first slanted section 6 of the arbitrary engagement feature 10 is connected to the distal section 82 of the adjacent engagement feature 11 at a straight angle. The distal section 82 of the adjacent engagement feature 11 and the proximal section 81 of the adjacent engagement feature 11 are adjacently positioned with each other with an obtuse angle. Furthermore, the proximal section 81 of second slanted section 8 and the distal section 82 of the second slanted section 8 are oriented at an obtuse angle thus delineating the gripping edge 40.

Figure 12:
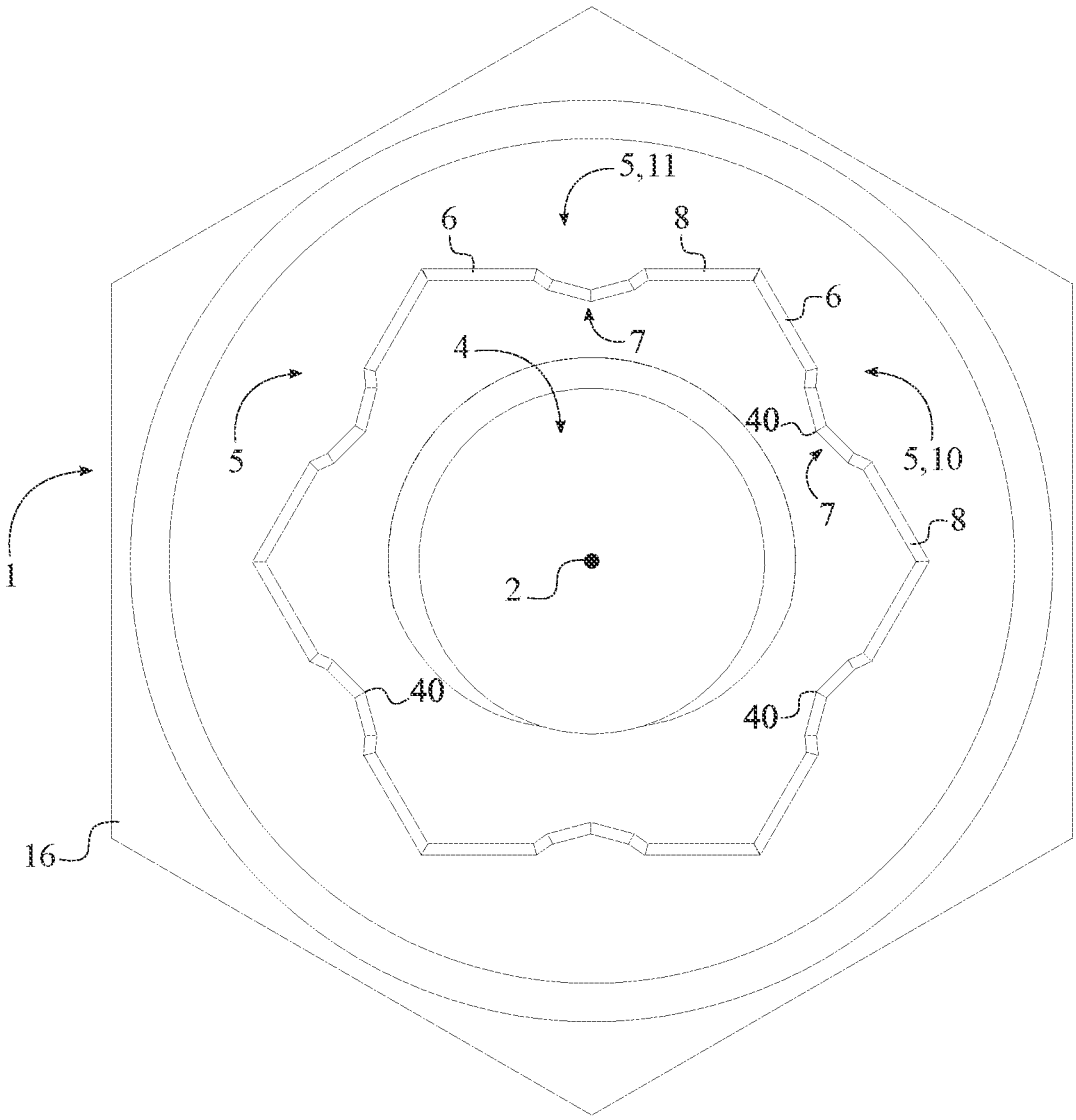
FIG. 12 is a top view of an alternative embodiment of the torque-tool body and the plurality of engagement features.

In reference to FIG. 12 that illustrates a second alternative embodiment of the torque-tool body 1, a cross section for each of the plurality of engagement features 5 comprises the first slanted section 6, the hollow section 7, and the second slanted section 8. The hollow section 7 further comprises a first section, a second section, a third section, and a fourth section. More specifically, the first section is adjacently connected to the second section. The third section is adjacently connected to the second section and positioned opposite of the first section. The fourth section is adjacently connected to the third section and positioned opposite of the second section. Resultantly, the first slanted section 6 is terminally connected to the first section. The second slanted section 8 is terminally connected to the fourth section, wherein the first slanted section 6 and the second slanted section 8 are oppositely positioned of each other about the hollow section 7. Furthermore, first slanted section 6 and the second slanted section 8 are linearly positioned with each other as the hollow section 7 oriented towards the rotational axis 2.

In reference to the first alternative embodiment of the torque-tool body 1, the gripping edge 40 is delineated within the hollow section 7 so that the gripping edge 40 is able to cut into the fastener head 61 during the removal of the damaged/stripped fastener 60. Furthermore, a first section, a second section, a third section, and a fourth section can be shaped into a plurality of straight sections, a plurality of curved section, or a combination of both the straight and curved sections. More specifically, the plurality of engagement features 5 comprises the arbitrary engagement feature 10 and the adjacent engagement feature 11. The arbitrary engagement feature 10 is any feature within the plurality of engagement features 5 in such a way that the adjacent engagement feature 11 is the feature directly next to the arbitrary engagement feature 10. In reference to FIG. 12, first slanted section 6 of the arbitrary engagement feature 10 is connected to the second slanted section 8 of the adjacent engagement feature 11 at an obtuse angle. In other words, adjacently positioned first slanted section 6 and the second slanted section 8 are oriented at an obtuse angle thus delineating the connection point between the pair of engagement features 5 as the gripping edge 40 is profiled within the hollow section 7.

Figure 21:
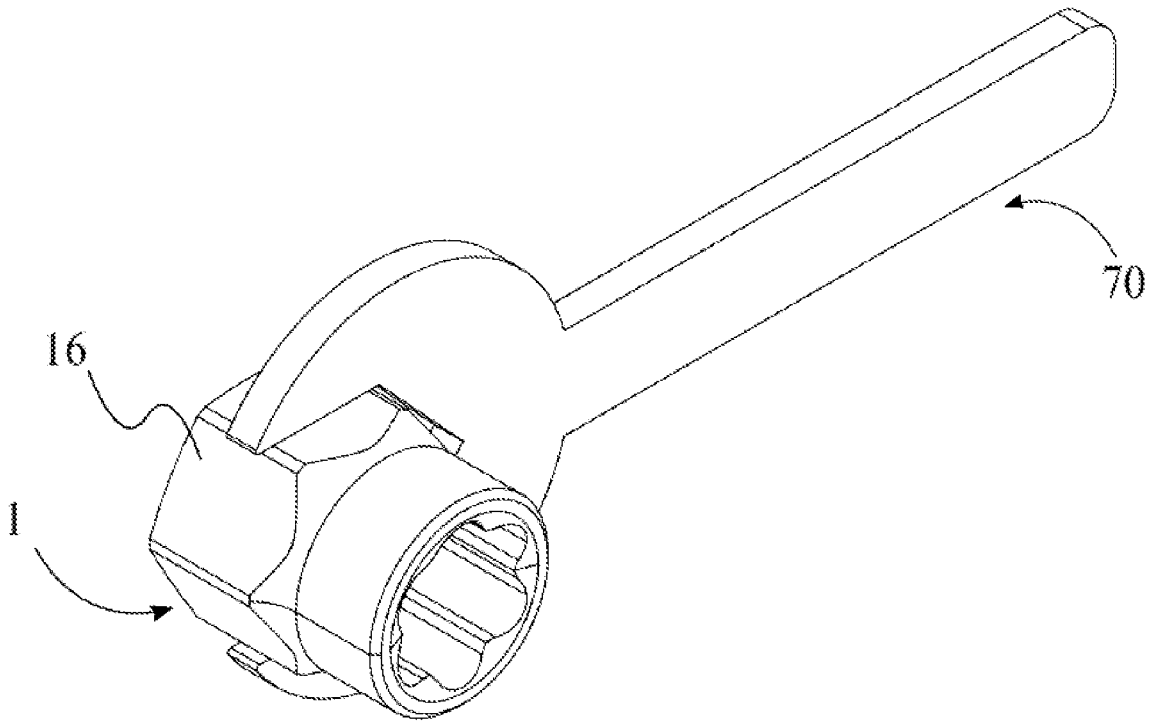
FIG. 21 is a perspective view of an embodiment of the torque-tool body being engaged by the torque arm.
Figure 22:
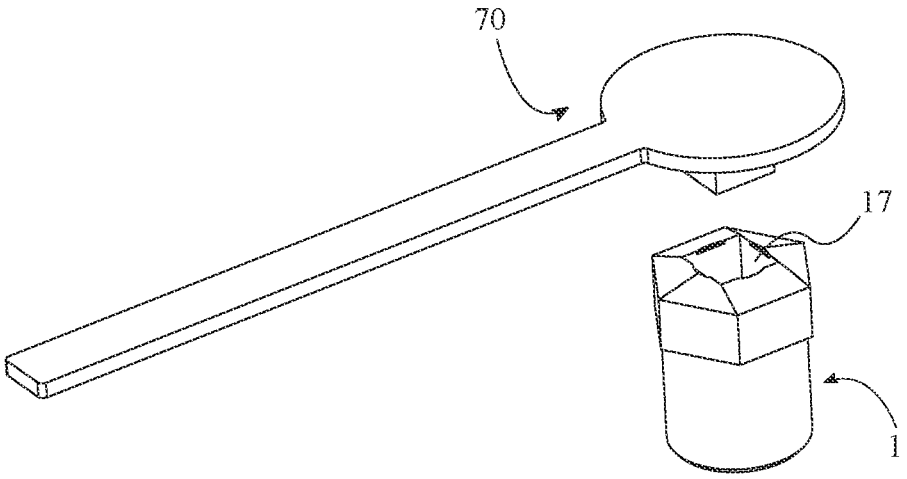
FIG. 22 is a perspective view of an embodiment of the torque-tool body being engaged by the torque arm.

In reference to FIG. 21, the method of the present invention also incorporates a torque arm 70 to attach to the torque-tool body 1 and increase the torque force applied to the damaged/stripped fastener 60. The torque arm comprises an engagement end for attachment to the torque-tool body 1. This engagement end may be a forked head, socket, or other surface appropriate for engaging with the torque-tool body 1. The torque arm 70 may be an external torque tool such as an open ended wrench, a box ended wrench, a combination wrench, an adjustable wrench, a ratchet wrench, and a socket wrench to be attached to the torque-tool body 1.

Figure 5:
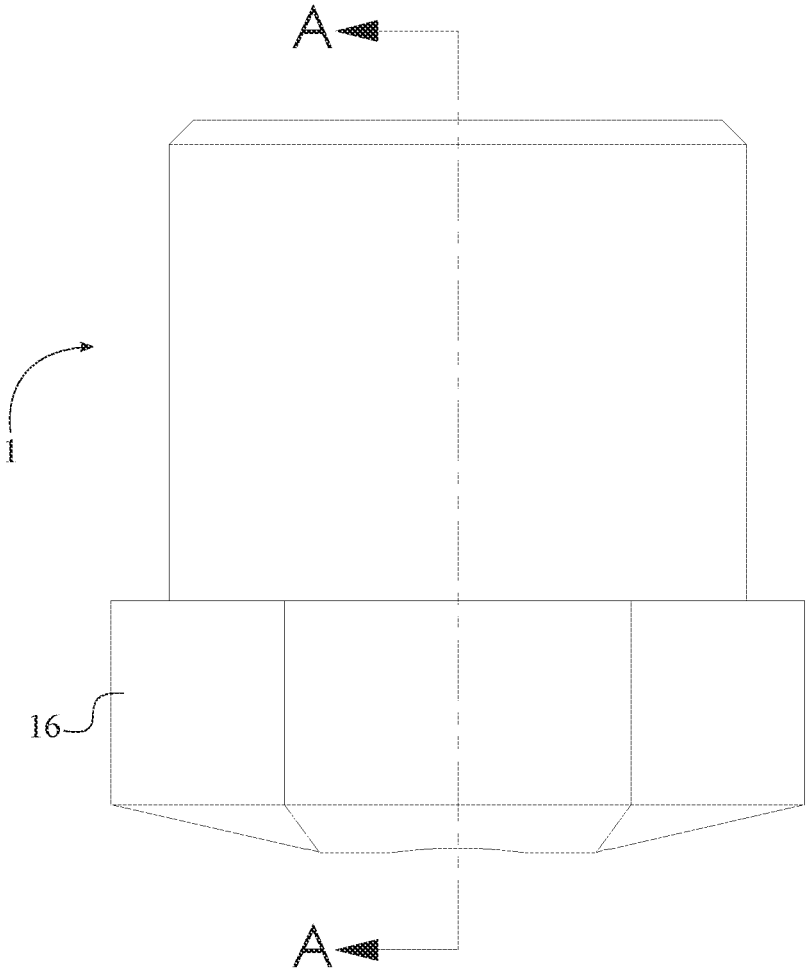
FIG. 5 is a side view of the torque-tool body, showing the plane upon which a cross sectional view is taken shown in FIG. 6.

In reference to FIG. 5-6, to facilitate use of the torque arm 70, some embodiments of the torque-tool body 1 further comprise an attachment body 16 and an engagement bore 17 as the attachment feature to allow a torque arm 70 to be attached to the torque-tool body 1. The attachment body 16 is centrally positioned around and along the rotational axis 2 in order to align with the axis of rotation of the torque tool body 1. Furthermore, the attachment body 16 is connected adjacent to the base 3 of the torque-tool body 1 and positioned opposite of the plurality of engagement features 5. The attachment body 16 is preferably of a hexagonal design with a diameter preferably and slightly larger than the diameter for the base 3 of the torque-tool body 1. However, the attachment body 16 may incorporate a smaller diameter than the base 3 depending on the base size and the preferred manufacturing method or design. The engagement bore 17 concentrically traverses through the attachment body 16 along the rotational axis 2. The engagement bore 17 is shaped to receive a male attachment member of a socket wrench, wherein the preferred shape of the engagement bore 17 is a square as the majority of socket wrenches utilize a square male attachment member. In alternative embodiments, the shape and design of the engagement bore 17 and the attachment body 16 may vary to be adaptable to different torque tools and different attachment means including, but not limited to, square or cylindrical. In an alternative embodiment, an outer surface of the attachment body 16 may have surface griping treatment applied such as knurling or other alternative methods that would increase the friction between torque-tool body 1 and any driven embodiments. In reference to FIG. 2 and FIG. 6, a bottom surface 31 of the attachment body 16 is tapered away from the engagement bore 17 so that the plurality of engagement features 5 can be driven into the damaged/stripped fastener 60 by a hammer, without hitting or damaging the engagement bore 17. In other words, a height of the attachment body 16 about the engagement bore 17 is slightly larger than a height of the attachment body 16 about the external surface of the attachment body 16 so that the bottom surface 31 can be tapered away from the engagement bore 17.

Figure 13:
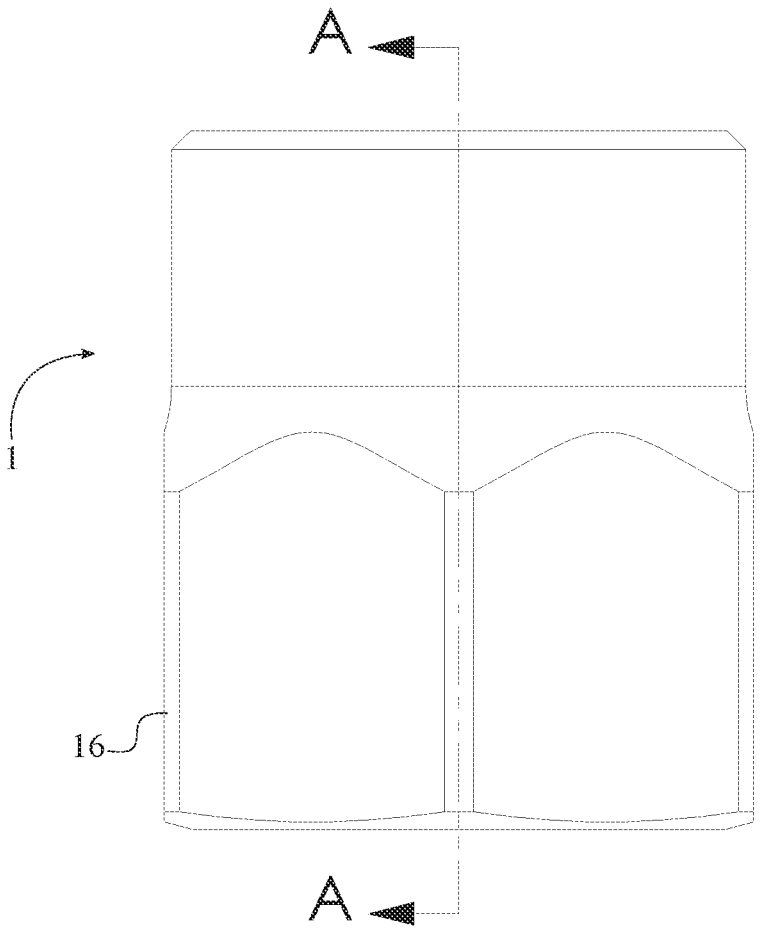
FIG. 13 is a side view of another embodiment of the torque-tool body, showing the plane upon which a cross sectional view is taken shown in FIG. 13.
Figure 14:
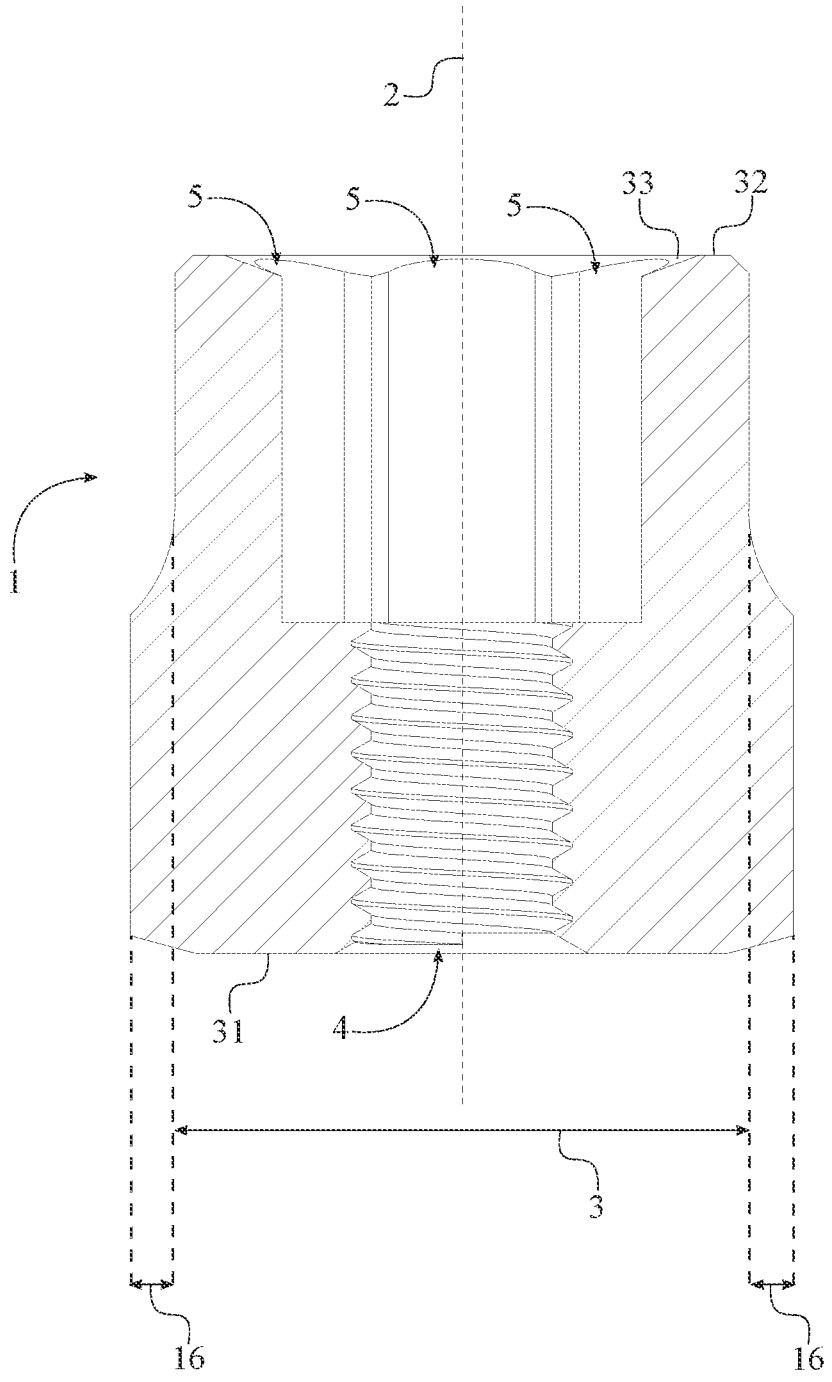
FIG. 14 is a cross section view of another embodiment of the torque-tool body taken along line A-A of FIG. 13, showing the laterally connected attachment body.

In reference to FIG. 13-14, some embodiment of the torque-tool body 1 further comprises only the attachment body 16 as the attachment feature to allow a torque arm 70 to be attached to the torque-tool body 1. The attachment body 16 is centrally positioned around and along the rotational axis 2 in order to align with the axis of rotation of the torque-tool body 1. Furthermore, the attachment body 16 is laterally connected around the base 3 of the torque-tool body 1 and the plurality of engagement features 5. Furthermore, a height 50 of the attachment body 16 is smaller than a total height 51 for the base 3 of the torque tool body 1 and the plurality of engagement features 5 as shown FIG. 19. The attachment body 16 is preferably of a hexagonal design with a diameter preferably and slightly larger than the diameter for the base 3 of the torque-tool body 1. However, in some alternative embodiments, the diameter of the attachment body 16 may be the same diameter of the base 3, or in further alternative embodiment of the present invention the diameter of the attachment body 16 may be less than a diameter of the base 3. In an alternative embodiment, an outer surface of the attachment body 16 may have surface griping treatment applied such as knurling or other alternative methods that would increase the friction between torque-tool body 1 and any driven embodiments. In the alternative embodiment as shown in FIGS. 13-14 the threaded opening 4 is incorporated through the attachment body 16.

Figure 7:
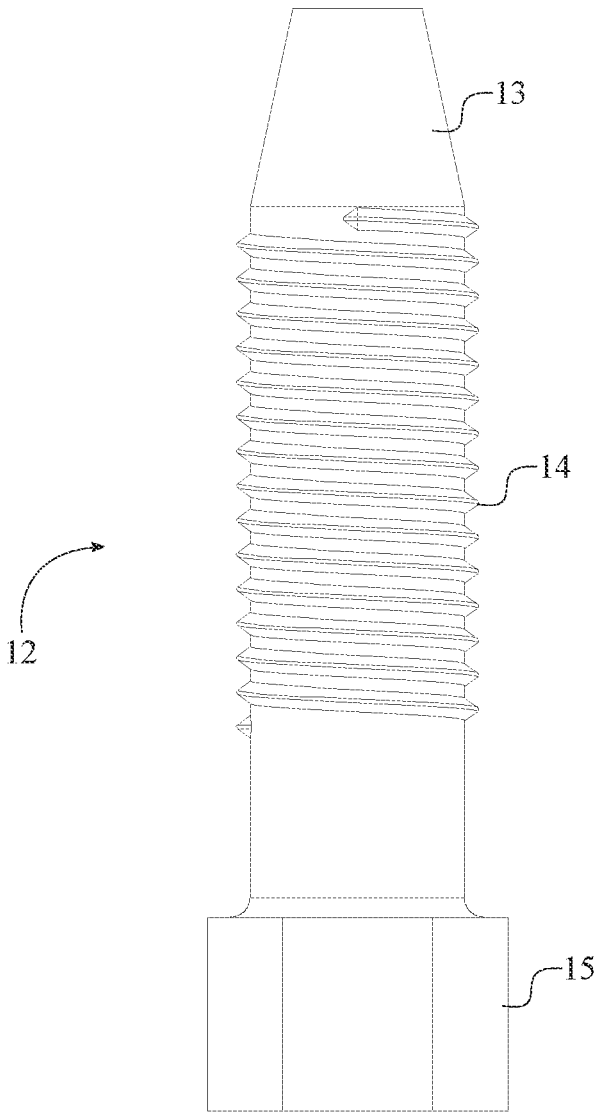
FIG. 7 is a side view of the release bolt.

In reference to FIG. 7, the release bolt 12 that dislodges the damaged/stripped fastener 60 comprises a bottom section 13, a threaded shaft section 14, and a driver section 15. More specifically, the bottom section 13 and the driver section 15 are oppositely positioned of each other about the threaded shaft section 14, wherein the preferred embodiment of the threaded shaft section 14 is a circular body. The bottom section 13, threaded shaft section 14, and the driver section 15 are axially positioned with each other so that the bottom section 13 is concentrically connected to the threaded shaft section 14 from one end, and the driver section 15 is concentrically connected to the threaded shaft section 14 from the opposite end. The bottom section 13 is preferably a tapered conical body; however, the bottoms section 13 can be formed into any other shape as long as the bottom section 13 can easily be inserted through the threaded opening 4. Furthermore, a cavity can laterally traverse into the driver section 15 so that a torque arm 70 can be engaged within the cavity to apply torque to the release bolt 12 when the release bolt 12 is engaged within the engagement bore 17. The cavity can be any profile including circular, square, or any other geometric profiles.

In reference to facilitate the engagement between the threaded opening 4 and the release bolt 12, the threaded shaft section 14 is designed to match the respective threads of the threaded opening 4 as shown in FIG. 8. When the damaged/stripped fastener 60 needs to be dislodged, the threaded shaft section 14 is engaged with the threaded opening 4. Resultantly, a base surface of the bottom section 13 is positioned adjacent and within the plurality of engagement features 5, as the driver section 15 is positioned offset of the torque-tool body 1. The user is able to apply the appropriate clockwise or counterclockwise torque to the release bolt 12 via the driver section 15, translating the rotational forces into linear forces until the damaged/stripped fastener 60 is released from the socket. Due to the internal positioning of the base surface of the bottom section 13 within the plurality of engagement features 5, the base surface of the bottom section 13 comes into contact and dislodges the damaged/stripped fastener 60 through the applied linear force. In the preferred embodiment of the driver section 15 is a hexagonal shape. However, in alternative embodiments, shapes of the driver section 15 can include, but is not limited to square, round, or internal drives which may be adapted to a different socket wrench or any other similar tool that can apply rotational force. The bottom section 13 may be shaped into cylindrical profile, a square profile, a hexagonal profile, or any other profile preferred by the user or the manufacturer. The threaded shaft section 14 may be any shaped shank including, but not limited to, a semi-round, a semi-square, or any other geometric shaped shank to which a male thread may be applied.

Figure 15:
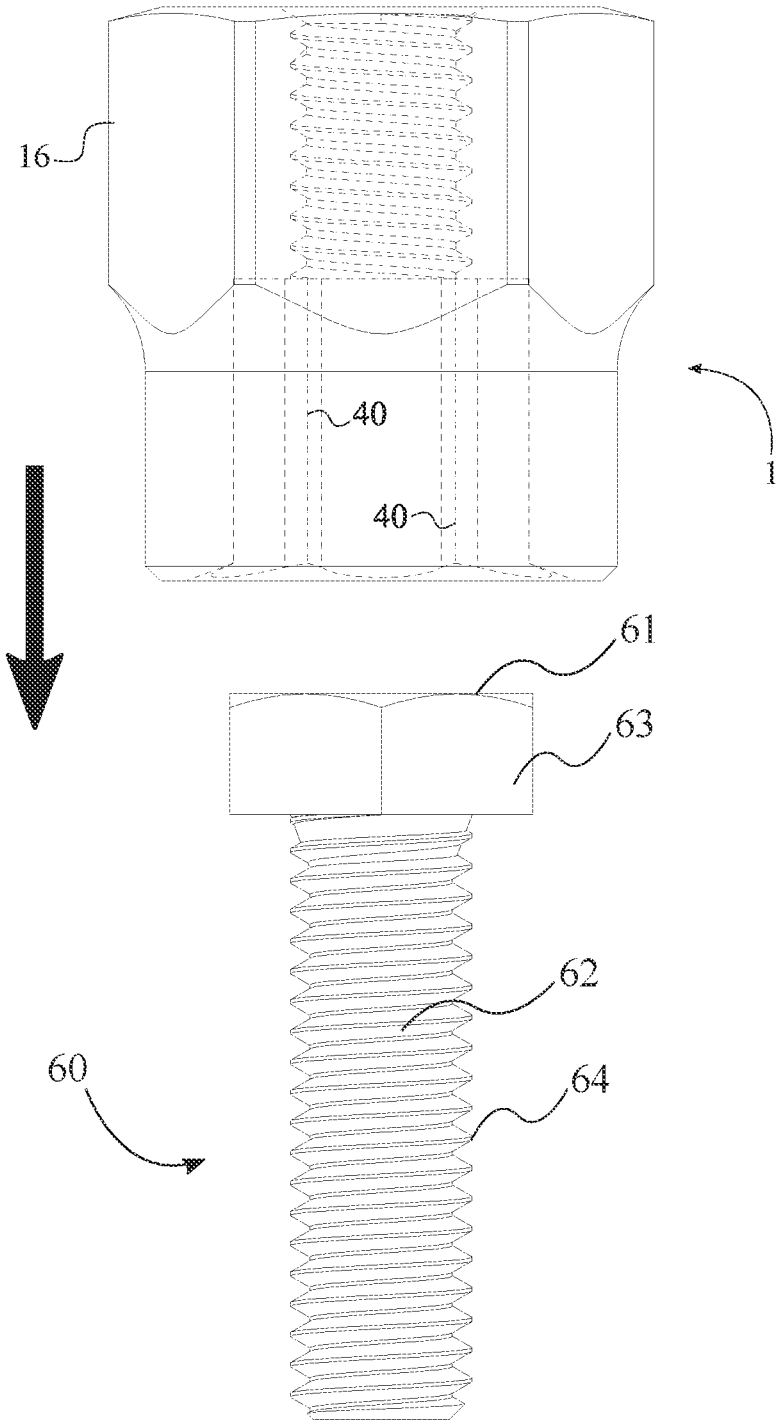
FIG. 15 is a side view of the torque-tool body before pushing around the damaged/stripped fastener.
Figure 16:
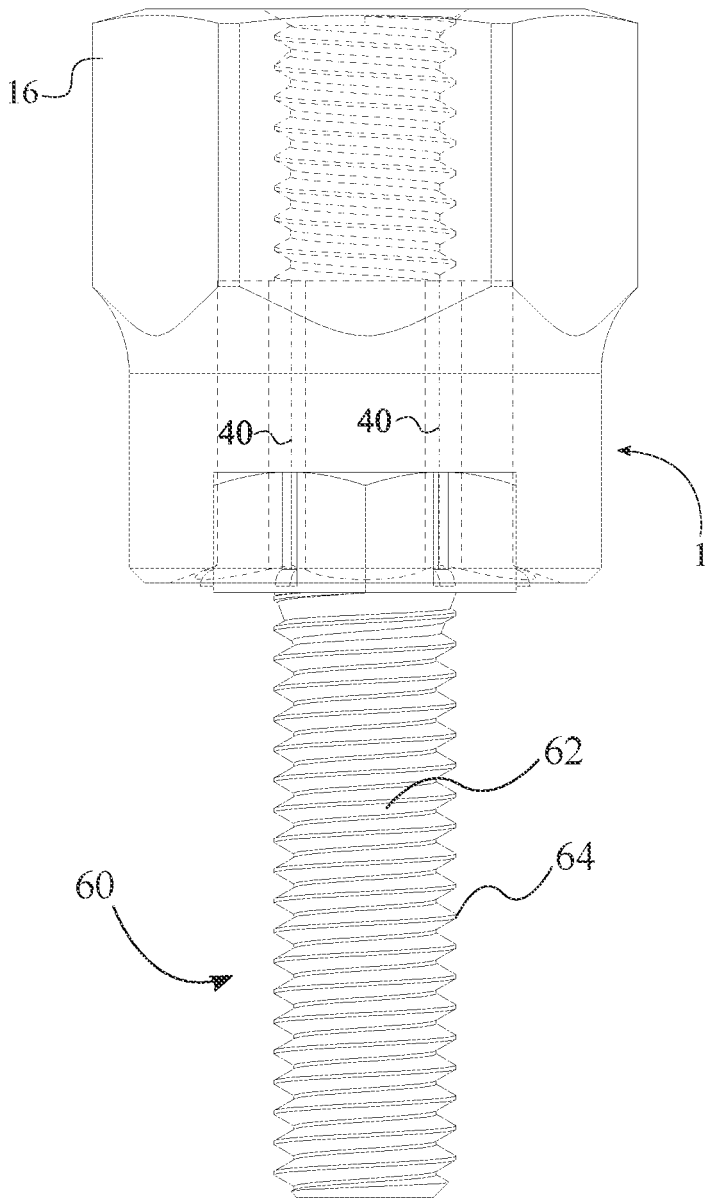
FIG. 16 is a side view of the torque-tool body being engaged around the damaged/stripped fastener, wherein each gripping edge cuts a channel into the damaged/stripped fastener.
Figure 17:
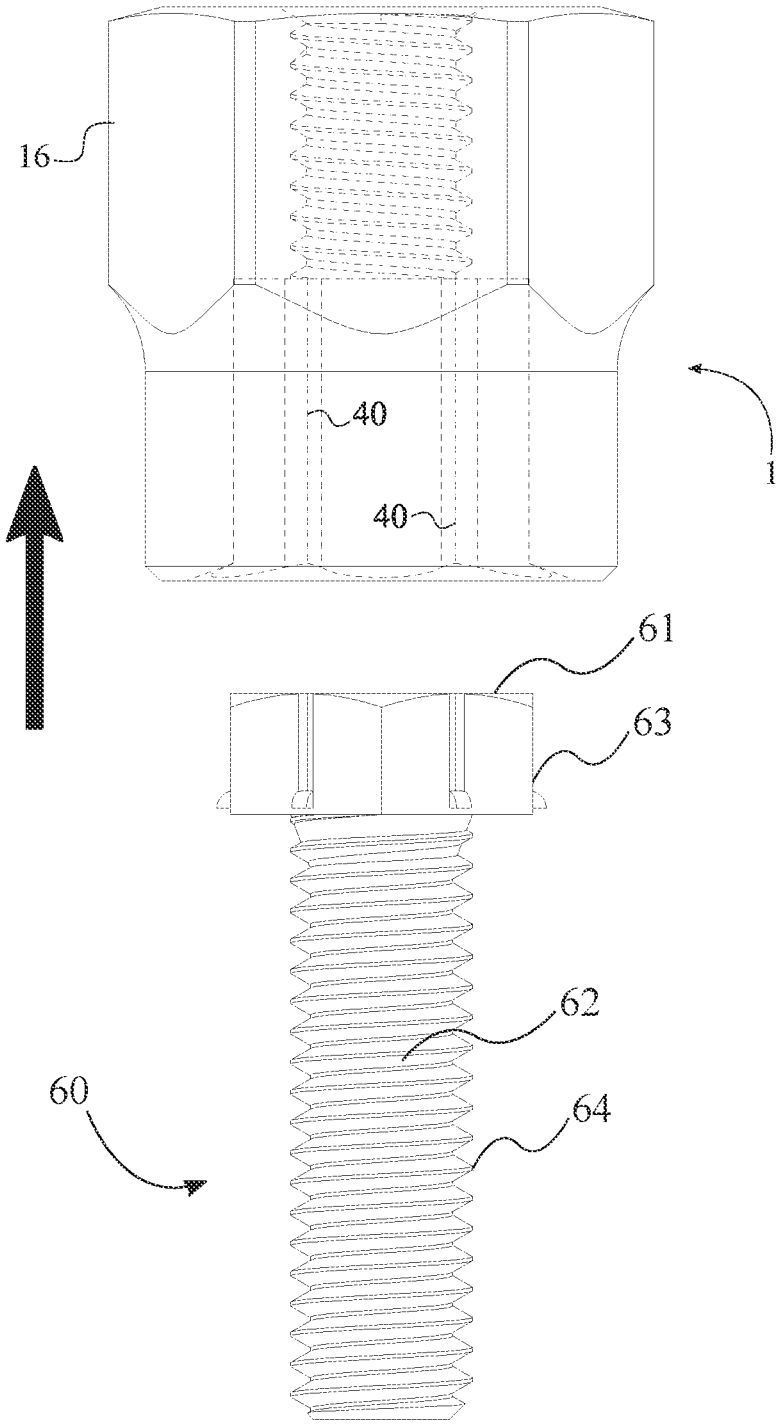
FIG. 17 is a side view of the torque-tool body being removed from the damaged/stripped fastener and showing the channel of the damaged/stripped fastener.

The functionality of the gripping edge 40 with respect to the preferred embodiment, the first alternative embodiment, and the second alternative embodiment remains consistent so that the torque-tool body is able to firmly grip around the fastener head 61 or the threaded shaft 62. More specifically, the gripping edge 40 is preferably an acute (sharp) point but may be a small radial convex portion, flat, or concave portion if preferred by the manufacturer. One of the unique features of the gripping edge 40 is the ability to cut, push and peel subject material away to create a groove or channel into a damaged/stripped fastener 60 as shown in FIG. 15-17. As a result, each gripping edge 40 is able securely clamp the present invention to the fastener head 61 or the threaded shaft 62, thereby creating a greatly enhanced engagement. The groove or channel is created parallel to the rotational axis 2, and perpendicular to the top surface 35 of the base 3. Additionally, each gripping edge 40 enables the present invention to function equally effectively in both clockwise and counterclockwise directions. Furthermore, because each gripping edge 40 is an acuate point that cuts and engages with the fastener head 61 or the threaded shaft 62, the possibility of slippage of the present invention is eliminated, whereas other spiral engagement extractor tools invite slippage due to the spiral engagement features being orientated in the same rotational direction as the torque force being applied to facilitate extracting process. Likewise, a traditional socket extracting tool that applies rotational force to the lateral walls of the fastener head is prone to slipping or damaging a fastener. The present invention is effective at engaging and applying rotational torque force to the fastener head 61 or the threaded shaft 62 without slipping by way of cutting grooves or channels to the subject to be rotated. Once the groove or channel is cut into the fastener head 61 or the threaded shaft 62 via the gripping edge 40, the dislodge material from the fastener head 61 or the threaded shaft 62 collects adjacent to the first slanted section 6, and a second slanted section 8 and the top chamfered surface 33 thus providing additional contact surface area between the present invention and the damaged/stripped fastener 60. As a result, the user is able to apply greater torque to the damaged/stripped fastener 60.

Figure 18:
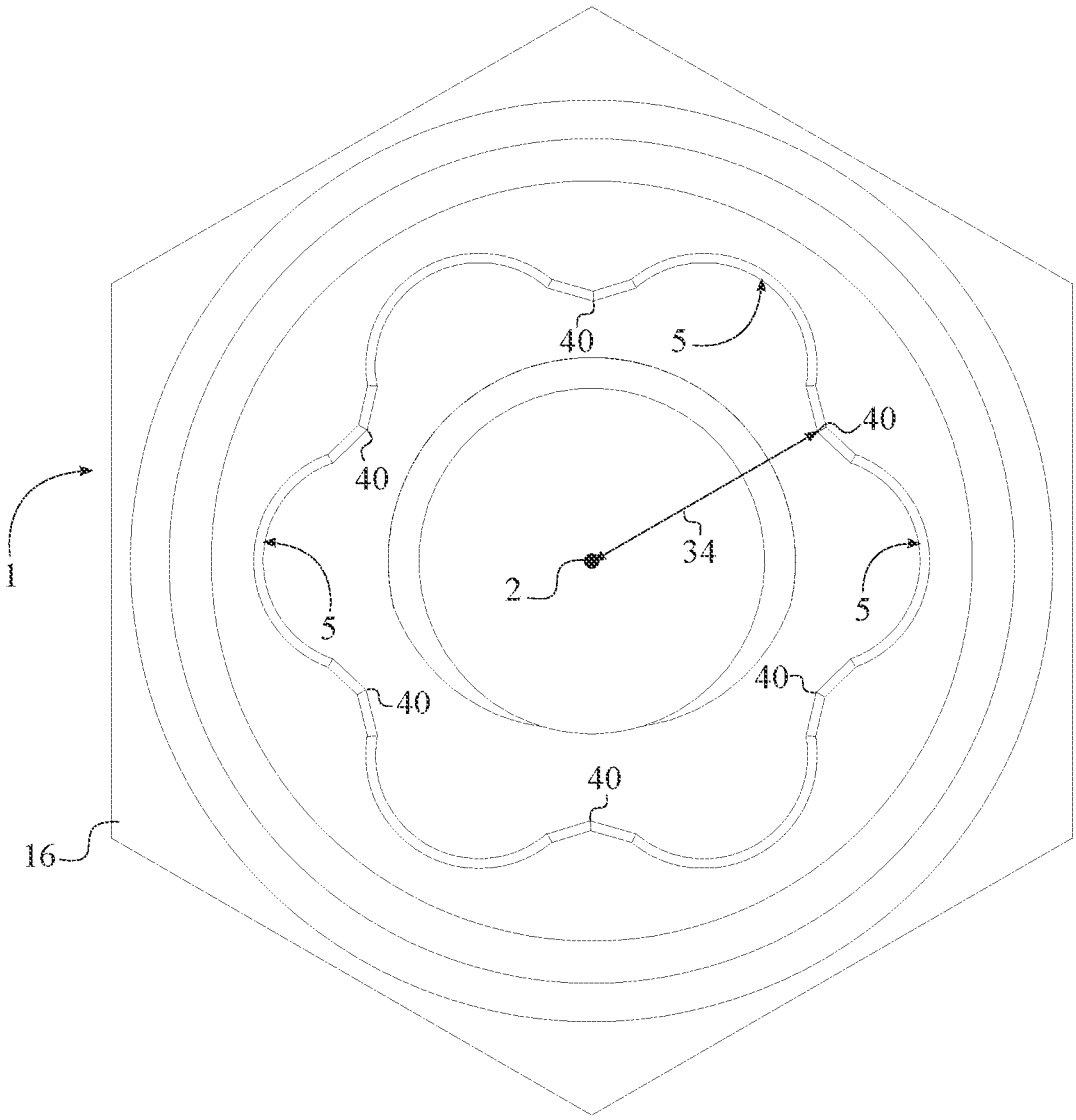
FIG. 18 is a top view of the torque-tool body and the plurality of engagement features, showing the channel cutting radius.

In reference to FIG. 18, the torque-tool body 1 further comprises a channel cutting radius 34 that is delineated from the rotational axis 2 to the gripping edge 40. In some embodiments, the channel cutting radius 34 is less than a radius of the fastener head 61 or the threaded shaft 62 by approximately 1-5%. Preferably, the channel cutting radius 34 is less than a radius of the fastener head 61 or the threaded shaft 62 by approximately 1-3%. The fastener radius is delineated from the fastener rotational axis to the fastener portion adjacent to the gripping edge 40 from the engagement features 5 of the torque tool body 1. In other words, the fastener radius is delineated by the distance from a fastener rotational axis to the nearest portion of the faster head 61 lateral wall 63, or threaded shaft 62 radial surface 64. The present methods of using the fastener radius may be applied to any threaded work piece able to be rotationally unthreaded or threaded including but not limited to threaded pipes, threaded nuts, and threaded studs.

Furthermore, the griping edge 40 engages about the center of the lateral wall 63 of a conventional male hexagonal fastener head 61 as shown in FIG. 17. As a result, even after the present invention has cut a groove or channel in the lateral wall 63 of the conventional male hexagonal fastener 60, the use of a conventional wrench or socket is not compromised. For example, even after the present invention is used to extract a traditional Hex fastener, a typical socket or wrench may be used to apply torque to the fastener 60 as the damage caused by the socket extractor is minimal and does not interfere with the fastener driving surface used by a standard tools. Additionally, the present invention is able to be used on a threaded shaft 62 without causing damage beyond the use of a nut after extraction. In other words, when the torque-tool body 1 is used to cut a groove or channel on the surface of a threaded shaft 62, a threaded nut may be used to fasten as required since the damage caused by the present invention is not prohibitive to the helical engagement of the threaded shaft and the threaded nut.

During engagement and the application of rotational torque to the fastener head 61 or the threaded shaft 62, the first slanted section 6 and the second slanted section 8 are angularly orientated with the lateral wall 63 of the fastener head 61 or radial surface 64 of the threaded shaft 62. As a result, the first slanted section 6 and the second slanted section 8 are preferably symmetrical to the lateral wall 63 of the fastener head 61 or radial surface 64 of the threaded shaft 63. In other words, the first slanted section 6 and the second slanted section 8 are offset and not parallel with the subject planar surface. The angular degrees offset with the fastener head 61 or the threaded shaft 62 are preferably all equal; however, the first slanted section 6 and the second slanted section 8 are not limited to this option.

Each griping edge 40 is symmetrically arranged and equally distanced circumferentially in a vertical direction along the rotational axis as shown in FIG. 3. In other words, the first slanted section 6 and the second slanted section 8 are non-tapered from the top surface 35 of the base 3 to the top flat surface 32. This feature greatly improves the present invention because there is an equal transfer of torque force to the fastener head 61 or the threaded shaft 62 along the total height of the plurality of engagement features 5 thus preventing the present invention from slipping off the fastener 60. It is well known by those in the knowledge of art that a tapered torque tool is subjected to slipping off the fastener head 61 or the threaded shaft 62 because the engagement between the tapered extractor tool and the fastener head 61 or the threaded shaft 62 is not equally distributed along the entire height of the plurality of engagement features 5.

Figure 19:
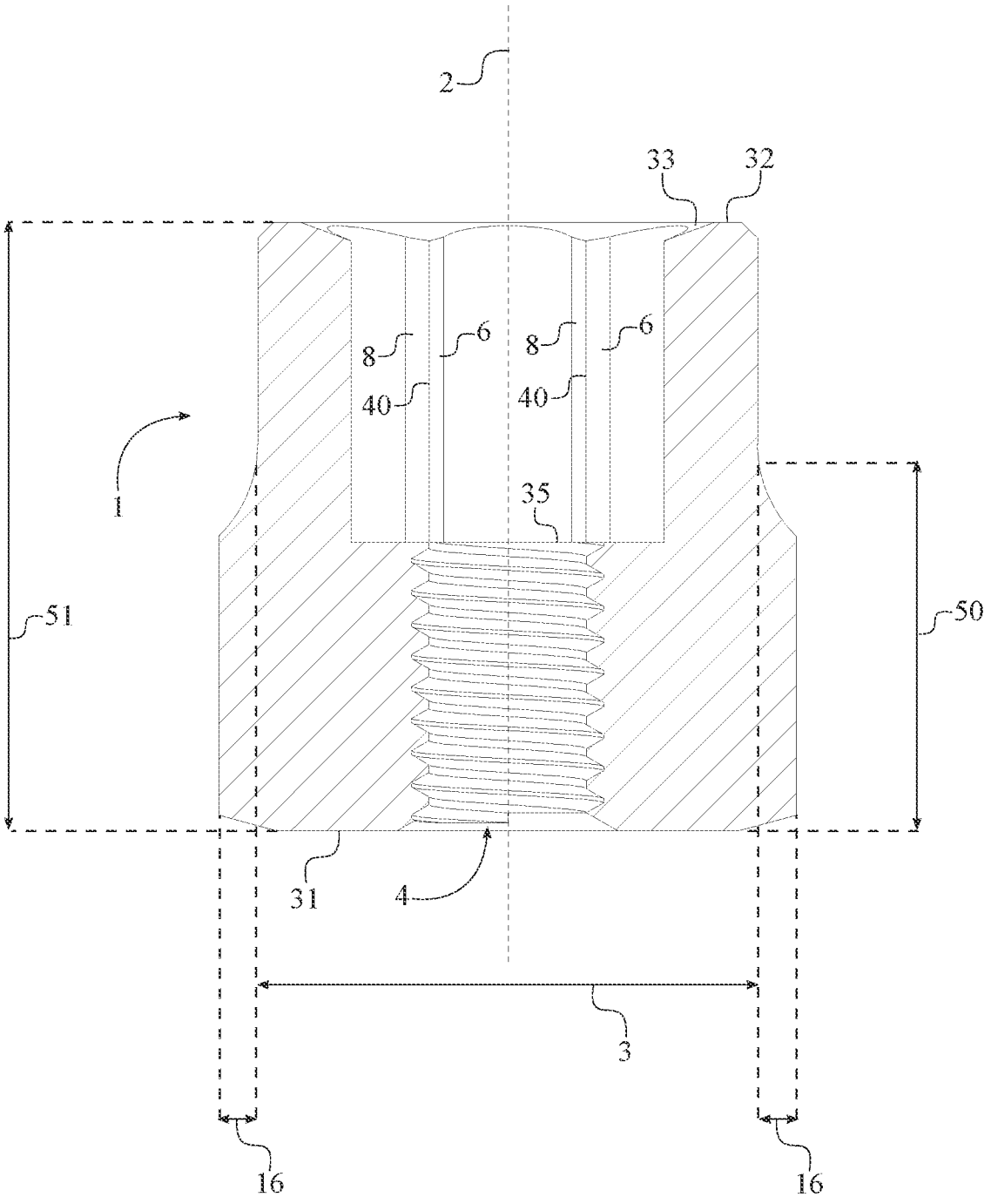
FIG. 19 is a side view of the torque-tool body and the plurality of engagement features, showing a smaller height the attachment body in comparison to the larger combine height of the torque-tool body and the plurality of engagement features.

The first slanted section 6 and the second slanted section 8 are straight and perpendicular to the top surface 35 of the base 3 as shown in FIG. 19. Furthermore, each gripping edge 40 of the arbitrary engagement feature 10 and the adjacent engagement feature 11 is positioned parallel to the rotational axis 2. In other words, the first slanted section 6, the second slanted section 8, and each gripping edge 40 are vertical in a direction from the top surface 35 of the base 3 to the top chamfered surface 33.

Figure 20:
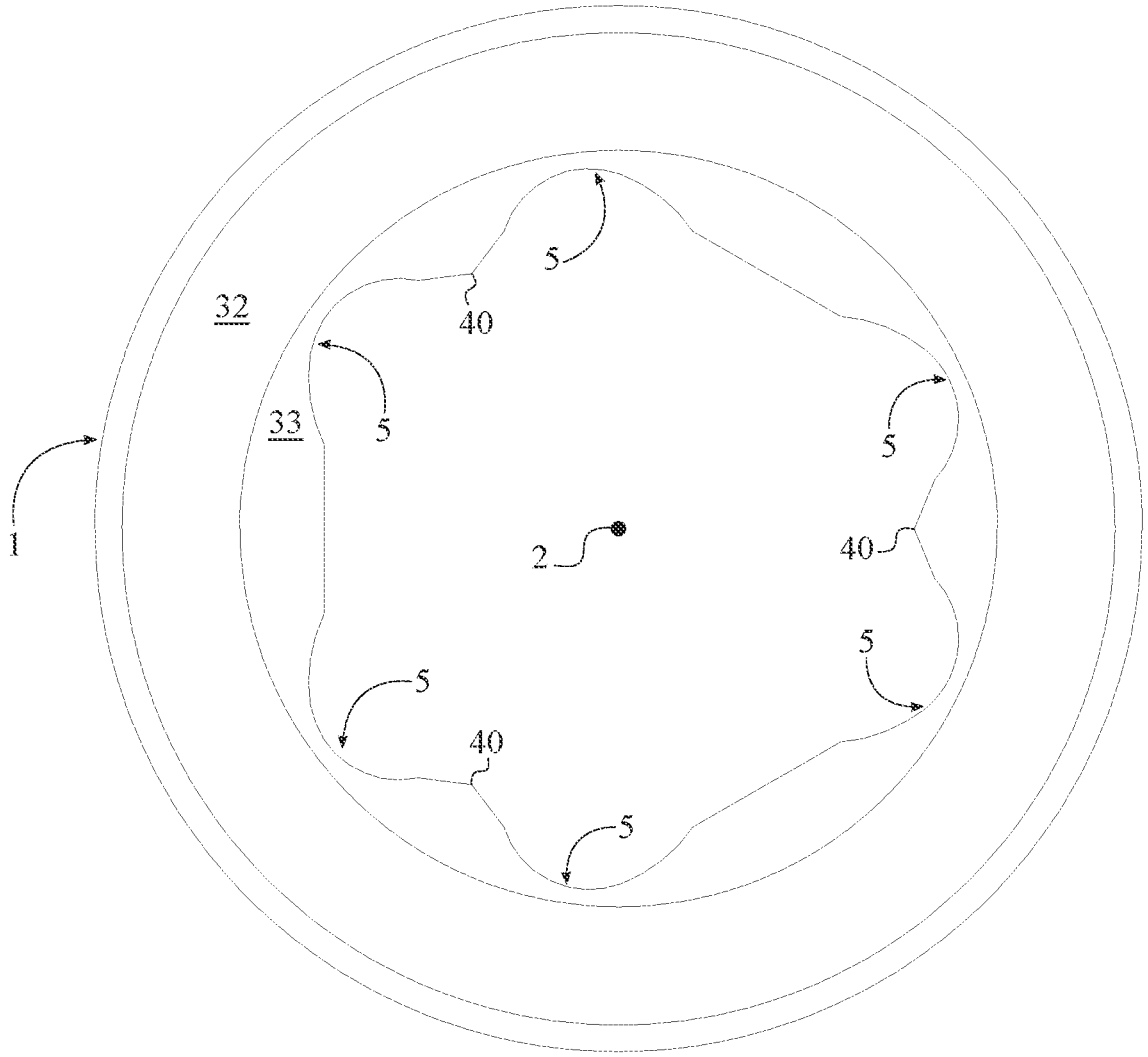
FIG. 20 is a top view of another embodiment of the torque-tool body and the plurality of engagement features with the intermediate sidewall portion.

The torque-tool body 1 may further incorporate an intermediate sidewall portion in between a first adjacent pair of the plurality of engagement features 5 and a second adjacent pair of the plurality of engagement features 5 as shown in FIG. 20. In other words, a corresponding engagement feature adjacent to a pair of plurality of engagement features 5 is replaced by the intermediate sidewall portion that can be a straight, radial, flat lateral surface sidewall or any other shape as preferred by the user.

In use, a torque-tool body 1 must be chosen that preferably matches the general shape of the fastener 60 to be removed. Choosing the correct torque-tool body 1 for a specific fastener generally requires matching the number of the plurality of engagement features 5 on the torque-tool body 1 with the number of lateral walls 63 on the fastener head 61. Some circumstances such as exceptionally compromised fasteners or asymmetric fasteners, a torque-tool body 1 may be chosen with the best size and fit for the fastener 60, taking into account the ability of the engagement features 5 to interact with the fastener 60. In some embodiments, it may be preferred the minimum diameter of the engagements features 5 is less than a fastener minimum diameter. Once an embodiment of the torque-tool body 1 is chosen, the torque-tool body 1 can be used in removal of the fastener 60.

To remove the damaged/stripped fastener 60 with the present invention, the torque-tool body 1 is positioned around the damaged/stripped fastener 60 so that a significant portion of the plurality of engagement features 5 are positioned around the fastener head 61 or the threaded shaft 62. In other words, the user needs to drive in the plurality of engagement features 5 into the fastener head 61 or the threaded shaft 62. In some embodiments, this is done using percussion blows so that each gripping edge 40 can cut vertical grooves into the fastener head 61 or the threaded shaft 62. In certain cases, these percussion blows may be achieved through the use of a hammer or other striking device. The user then simply applies a torque force to the torque-tool body 1 in the loosening direction using a torque arm 70 by way of attachment body 16, or engagement bore 17, in order to rotate and remove the damaged/stripped fastener 60 from a female thread. When a torque force is applied to the torque-tool body 1, the plurality of engagement features 5 "bite" into the lateral walls 63 of fastener head 61 or the threaded shaft 62, which in turn rotates the fastener 60. In some embodiments of the present method, the user may apply a torque force to the torque arm 70 in the tightening direction to break the fastener 60 loose of corrosion, rust, or any other seized conditions before continuing to rotate the fastener in the loosening direction. In some situations where the fastener is extremely seized or a anti loosening agent was previously applied to fastener 63, the method may include inserting the release bolt 12 into the threaded opening 4 of the torque tool body 1 and applying rotational torque force to the release bolt 12 to push the torque tool body 1 off the fastener 60. Once the torque tool body 1 has been removed from the fastener 60, heat and or anti seizing agents can be applied to the fastener without obstruction from the torque tool body 1 or without causing damage the torque tool body 1. The fastener loosening process can then be resumed and the torque tool body can be driven back into the fastener as previously described. The methods and apparatuses of the present invention may be used to engage new, partially stripped, or fully stripped fastener heads 61. The present invention overcomes slippage of the fastener head 61 through the use of the plurality of engagement features 5 since each pair of the plurality of engagement features 5 delineates the gripping edge 40.

To tighten or insert a damaged/stripped fastener 60, the user may simply reinsert the removed fastener 60 into the female thread body and tighten the fastener using the torque arm 70 to rotate the torque tool body 1 in the tightening direction. If the user needs to insert a damaged/stripped fastener that is detached from the torque tool body, a similar sequence of steps may be used as the method of removing a damaged/stripped fastener 60. The torque-tool body 1 is positioned around the damaged/stripped fastener 60 so that a significant portion of the plurality of engagement features 5 are positioned around the fastener head 61 or the threaded shaft 62. The user drives the plurality of engagement features 5 into the fastener head 61 or the threaded shaft 62. This can again be done using percussion blows so that each gripping edge 40 can cut into the fastener head 61 or the threaded shaft 62. Unlike the removal process, the user then applies a torque force in the tightening direction to the torque-tool body 1 using the torque arm 70 in order to rotate and insert or tighten the damaged/stripped fastener 60.

It is to be further understood that even though the aforementioned method describes the fastener 60 as a male threaded embodiment being removed from a female thread body, the present invention is not limited to this option as the present invention may also be used in an opposite method using the same or similar sequence of steps as previously described wherein the torque tool body 1 is used to rotate and remove a female thread body, commonly known as a threaded nuts, from a male fastener thread body.

The methods described for removing and inserting a damaged/stripped fastener 60 describe a torque force in a loosening direction and tightening direction respectively for removing and inserting the fastener 60. While the directional nature of theses torque force is generally understood to be counter-clockwise for loosening and clockwise for tightening as is the common operation of fasteners, the torque-tool body 1 is bi-directional and a counter-clockwise or clockwise torque force may be applied to the torque-tool body 1 for either insertion or removal of the fastener 60, depending on the nature of the fastener connection.

To dislodge the damaged/stripped fastener 60 from the torque-tool body 1 after removing or tightening the fastener 60, the release bolt 12 is used. The threaded shaft section 14 is engaged with the threaded opening 4 of the torque-tool body 1. The user may then apply appropriate clockwise or counterclockwise torque to the release bolt 12 via the driver section 15. This torque may be applied by hand or through the use of a tool such as the torque arm 70. In certain cases where the fastener cannot be easily dislodged from the torque-tool body, additional steps may be taken such as utilizing a second torque arm 70 to simultaneously apply torque oppositely to the torque-tool body 1 and the release bolt 12. During the fastener dislodging method, the fastener 60 and the release bolt 12 move in the same direction along and parallel to the rotational axis, the fastener 60 is moving vertically away from the torque tool body 1. Additionally, heat and/or lubrication may be applied to the apparatuses of the present method to aid in removal of the damaged/stripped fastener 60 from the torque-tool body 1. It is to be understood that the present invention can be used in the aforementioned method or methods to remove any threaded object or embodiment that is able to be loosened or tightened via a thread method and is not limited in its use on male threaded fasteners, studs or female threaded nuts.

Although the invention has been explained in relation to its preferred embodiment, it is to be understood that many other possible modifications and variations can be made without departing from the spirit and scope of the invention.

What is claimed is:

1. A method for engaging a threaded fastener, the method comprising the following steps:

providing a threaded fastener, the threaded fastener having a fastener head and a shaft with a lateral thread;

providing a torque-tool body, the torque-tool body having a first open end with a plurality of engagement features radially positioned around a rotational axis of the torque-tool body and a gripping edge configured to vertically cut a channel into the threaded fastener, and a second open end with a threaded opening opposite the first open end;

providing a release bolt, the release bolt having a threaded shaft section and a driver section, wherein the release bolt is configured to dislodge the threaded fastener from the torque-tool body;

engaging the torque-tool body with the threaded fastener by aligning the plurality of engagement features of the torque-tool body with the fastener head and pressing the torque-tool body around the fastener head;

applying rotational torque to the torque-tool body in a loosening direction of the threaded fastener to unthread the threaded fastener;

threadedly engaging the threaded shaft section of the release bolt with the threaded opening of the torque-tool body; and applying rotational torque to the driver section of the release bolt to remove the threaded fastener from the torque-tool body, wherein the release bolt moves parallel to the rotational axis of the torque-tool body into contact with the threaded fastener to dislodge the threaded fastener from the torque-tool body.

2. The method for engaging a threaded fastener in an object, as claimed in claim 1, further comprising:

providing a first torque arm;

the torque-tool body further comprising an attachment body;

engaging the first torque arm with the attachment body; and the step of applying rotational torque to the torque-tool body being accomplished by applying lateral force to the first torque arm.

3. The method for engaging a threaded fastener in an object, as claimed in claim 2, further comprising:

providing a second torque arm;

engaging the second torque arm with the driver section of the release bolt; and the step of applying rotational torque to the driver section of the release bolt being accomplished by applying opposite lateral forces to the first torque arm and the second torque arm.

4. The method for engaging a threaded fastener in an object, as claimed in claim 1, further comprising:

providing a first torque arm;

the torque-tool body further comprising an engagement bore;

engaging the first torque arm with the engagement bore; and the step of applying rotational torque to the torque-tool body being accomplished by applying lateral force to the first torque arm.

5. The method for engaging a threaded fastener in an object, as claimed in claim 1, the step of providing the torque-tool body further comprising:

determining a number of lateral walls on the fastener head; and selecting the torque-tool body to have a number of engagement features equal to the number of lateral walls on the fastener head.

6. The method for engaging a threaded fastener in an object, as claimed in claim 1, further comprising:

the torque-tool body having a channel cutting radius that is delineated from the rotational axis to the gripping edge; and the step of providing the torque-tool body further comprising selecting the torque-tool body to have a channel cutting radius less than a radius of the fastener head.

7. The method for engaging a threaded fastener in an object, as claimed in claim 1, further comprising:

applying rotational torque to the torque-tool body in a tightening direction of the threaded fastener to remedy a seized condition.

8. The method for engaging a threaded fastener in an object, as claimed in claim 1, the step of engaging the torque-tool body with the threaded fastener further comprising:

applying percussion blows to the torque-tool body to further engage the torque-tool body with the threaded fastener.

9. A method for engaging a threaded fastener, the method comprising the following steps:

providing a threaded fastener, the threaded fastener having a shaft with a lateral thread;

providing a torque-tool body, the torque-tool body having a first open end with a plurality of engagement features radially positioned around a rotational axis of the torque-tool body and a gripping edge configured to vertically cut a channel into the threaded fastener, and a second open end with a threaded opening opposite the first open end;

providing a release bolt, the release bolt having a threaded shaft section and a driver section, wherein the release bolt is configured to dislodge the threaded fastener from the torque-tool body;

engaging the torque-tool body with the threaded fastener by aligning the plurality of engagement features of the torque-tool body with the lateral thread of the shaft of the threaded fastener and pressing the torque-tool body around the shaft of the threaded fastener;

applying rotational torque to the torque-tool body in a loosening direction of the threaded fastener to unthread the threaded fastener;

threadedly engaging the threaded shaft section of the release bolt with the threaded opening of the torque-tool body; and applying rotational torque to the driver section of the release bolt to remove the threaded fastener from the torque-tool body, wherein the release bolt moves parallel to the rotational axis of the torque-tool body into contact with the threaded fastener to dislodge the threaded fastener from the torque-tool body.

10. The method for engaging a threaded fastener in an object, as claimed in claim 9, further comprising:

providing a first torque arm;

the torque-tool body further comprising an attachment body;

engaging the first torque arm with the attachment body; and the step of applying rotational torque to the torque-tool body being accomplished by applying lateral force to the torque arm.

11. The method for engaging a threaded fastener in an object, as claimed in claim 10, further comprising:

providing a second torque arm;

engaging the second torque arm with the driver section of the release bolt; and the step of applying rotational torque to the driver section of the release bolt being accomplished by applying opposite lateral forces to the first torque arm and the second torque arm.

12. The method for engaging a threaded fastener in an object, as claimed in claim 9, further comprising:

providing a first torque arm;

the torque-tool body further comprising an engagement bore;

engaging the first torque arm with the engagement bore; and the step of applying rotational torque to the torque-tool body being accomplished by applying lateral force to the first torque arm.

13. The method for engaging a threaded fastener in an object, as claimed in claim 9, further comprising:

the torque-tool body having a channel cutting radius that is delineated from the rotational axis to the gripping edge; and the step of providing the torque-tool body further comprising selecting the torque-tool body to have a channel cutting radius less than a radius of the shaft of the threaded fastener.

14. The method for engaging a threaded fastener in an object, as claimed in claim 9, further comprising:

applying rotational torque to the torque-tool body in a tightening direction of the threaded fastener to remedy a seized condition.

15. The method for engaging a threaded fastener in an object, as claimed in claim 9, the step of engaging the torque-tool body with the threaded fastener further comprising:

applying percussion blows to the torque-tool body to further engage the torque-tool body with the threaded fastener.

16. A method for engaging a threaded fastener in an object, the method comprising the following steps:

providing a threaded fastener, the threaded fastener having a fastener head and a shaft with a lateral thread;

providing a torque-tool body, the torque-tool body having a first open end with a plurality of engagement features radially positioned around a rotational axis of the torque-tool body and a gripping edge configured to vertically cut a channel into the threaded fastener, and a second open end with a threaded opening opposite the first open end;

providing a release bolt, the release bolt having a threaded shaft section and a driver section, wherein the release bolt is configured to dislodge the threaded fastener from the torque-tool body;

engaging the torque-tool body with the threaded fastener by aligning the plurality of engagement features of the torque-tool body with the fastener head and pressing the torque-tool body around the fastener head;

applying rotational torque to the torque-tool body in a tightening direction of the threaded fastener to thread the threaded fastener;

threadedly engaging the threaded shaft section of the release bolt with the threaded opening of the torque-tool body; and applying rotational torque to the driver section of the release bolt to remove the threaded fastener from the torque-tool body, wherein the release bolt moves parallel to the rotational axis of the torque-tool body into contact with the threaded fastener to dislodge the threaded fastener from the torque-tool body.

17. The method for engaging a threaded fastener in an object, as claimed in claim 16, further comprising:

providing a first torque arm;

the torque-tool body further comprising an attachment body;

engaging the first torque arm with the attachment body; and the step of applying rotational torque to the torque-tool body being accomplished by applying lateral force to the first torque arm.

18. The method for engaging a threaded fastener in an object, as claimed in claim 17, further comprising:

providing a second torque arm;

engaging the second torque arm with the driver section of the release bolt; and the step of applying rotational torque to the driver section of the release bolt being accomplished by applying opposite lateral forces to the first torque arm and the second torque arm.

19. The method for engaging a threaded fastener in an object, as claimed in claim 16, further comprising:

providing a first torque arm;

engaging the first torque arm with the driver section of the release bolt; and the step of applying rotational torque to the driver section of the release bolt being accomplished by applying lateral force to the first torque arm.

20. The method for engaging a threaded fastener in an object, as claimed in claim 16, the step of providing the torque-tool body further comprising:

determining a number of lateral walls on the fastener head; and selecting the torque-tool body to have a number of engagement features equal to the number of lateral walls on the fastener head.

21. The method for engaging a threaded fastener in an object, as claimed in claim 16, further comprising:

the torque-tool body having a channel cutting radius that is delineated from the rotational axis to the gripping edge; and the step of providing the torque-tool body further comprising selecting the torque-tool body to have a channel cutting radius less than a radius of the fastener head.

22. The method for engaging a threaded fastener in an object, as claimed in claim 16, further comprising:

applying rotational torque to the torque-tool body in a loosening direction of the threaded fastener to remedy a seized condition.

23. The method for engaging a threaded fastener in an object, as claimed in claim 16, the step of engaging the torque-tool body with the threaded fastener further comprising:

applying percussion blows to the torque-tool body to further engage the torque-tool body with the threaded fastener.

* * * * *